US008714393B2

(12) United States Patent
Buck

(10) Patent No.: US 8,714,393 B2
(45) Date of Patent: May 6, 2014

(54) CUP LID WITH INTEGRATED CONTAINER

(76) Inventor: Ronald Mark Buck, Encinitas, CA (US)

( * ) Notice: Subject to any disclaimer, the term of this patent is extended or adjusted under 35 U.S.C. 154(b) by 0 days.

(21) Appl. No.: 13/437,902

(22) Filed: Apr. 2, 2012

(65) Prior Publication Data

US 2013/0056475 A1 Mar. 7, 2013

Related U.S. Application Data

(63) Continuation of application No. 13/226,346, filed on Sep. 6, 2011, now Pat. No. 8,596,491.

(51) Int. Cl.
*A47G 19/22* (2006.01)

(52) U.S. Cl.
USPC ..... 220/253; 220/713; 220/212; 220/709; 220/521; 220/523; 220/821

(58) Field of Classification Search
USPC ..... 220/4.01, 4.03, 4.27, 212, 254.3, 254.5, 220/259.1, 505, 521, 523, 709, 713, 253, 220/821; 206/217, 501, 514, 546, 815; 426/112, 115, 120
See application file for complete search history.

(56) References Cited

U.S. PATENT DOCUMENTS

| | | | |
|---|---|---|---|
| 1,600,758 | A | 9/1926 | Goldstein |
| 1,665,289 | A | 4/1928 | Weaver |
| 2,241,044 | A | 5/1941 | Knut |
| 3,288,344 | A | 11/1966 | Woollen |
| 3,323,706 | A | 6/1967 | Gereke |
| 3,413,128 | A | 11/1968 | Steinbarth et al. |
| 3,421,654 | A | 1/1969 | Hexel |
| 3,439,841 | A | 4/1969 | Irving |
| 3,616,897 | A | 11/1971 | Vrana |
| 3,679,089 | A | 7/1972 | Swett et al. |
| 3,817,419 | A | 6/1974 | Moller et al. |
| 4,054,205 | A | 10/1977 | Blow, Jr. et al. |
| 4,074,827 | A | 2/1978 | Labe, III |
| 4,091,953 | A | 5/1978 | Daenen |
| 4,380,307 | A | 4/1983 | Stillinger |
| 4,627,537 | A | 12/1986 | Rogers |
| 4,699,299 | A | 10/1987 | Gach |
| 5,145,646 | A | 9/1992 | Tyranski |
| 5,180,079 | A | 1/1993 | Jeng |

(Continued)

FOREIGN PATENT DOCUMENTS

| | | |
|---|---|---|
| EP | 1397986 | 3/2004 |

OTHER PUBLICATIONS

International Search Report Dated Mar. 19, 2013, 14 pages.

*Primary Examiner* — Anthony Stashick
*Assistant Examiner* — James N Smalley
(74) *Attorney, Agent, or Firm* — ARC IP Law, PC; Joseph J. Mayo

(57) ABSTRACT

Cup lid with integrated container(s) that couples with the top of a cup. The cup and cup lid form at least two containment volumes, Embodiments enable easy containment, inclusion of fresh food, transportation and access of solid or liquid in the container and cup without disengagement of the cup lid from the cup. Coupling elements that couple the cup lid to the cup, or that couple containers to the lid cavity may be non-permanent, semi-permanent or permanent. Simplifies eating and drinking from one container and cup in a theater or stadium having seats for example that provide one cup-holder per seat. Provides one free hand to hold a child's hand for safety while in stadiums and amusement parks.

20 Claims, 19 Drawing Sheets

(56) References Cited

U.S. PATENT DOCUMENTS

| | | | | |
|---|---|---|---|---|
| 5,283,140 | A | 2/1994 | Netz et al. | |
| 5,310,072 | A | 5/1994 | Matusovsky et al. | |
| 5,318,787 | A | 6/1994 | Brauner | |
| 5,402,903 | A | 4/1995 | Mann | |
| 5,503,858 | A * | 4/1996 | Reskow | 426/119 |
| 5,573,131 | A | 11/1996 | Berjis | |
| 5,624,053 | A | 4/1997 | Freek et al. | |
| 5,720,555 | A | 2/1998 | Elele | |
| 5,743,423 | A | 4/1998 | Franco | |
| D397,911 | S | 9/1998 | Waldmann | |
| 5,954,195 | A | 9/1999 | Krueger et al. | |
| 6,003,671 | A | 12/1999 | McDonough et al. | |
| 6,079,586 | A | 6/2000 | Hanneman | |
| 6,085,919 | A | 7/2000 | Singer | |
| 6,119,884 | A * | 9/2000 | Lowry | 220/62.13 |
| 6,164,485 | A | 12/2000 | Hilton | |
| 6,209,748 | B1 | 4/2001 | Dunbar | |
| 6,299,014 | B1 | 10/2001 | Nava et al. | |
| 6,314,866 | B1 | 11/2001 | Melton | |
| 6,338,417 | B1 * | 1/2002 | Ferraro | 220/23.83 |
| 6,412,526 | B2 | 7/2002 | Castillo | |
| 6,425,480 | B1 | 7/2002 | Krueger et al. | |
| 6,427,864 | B1 | 8/2002 | Asselin | |
| 6,528,105 | B1 | 3/2003 | Gerhart et al. | |
| 6,557,698 | B2 | 5/2003 | Gordon | |
| 6,641,854 | B2 | 11/2003 | Gerhart | |
| 6,706,297 | B1 | 3/2004 | Toth et al. | |
| 6,708,735 | B1 | 3/2004 | Kenihan | |
| 6,793,075 | B1 | 9/2004 | Jeter | |
| 6,932,231 | B2 | 8/2005 | Haynes | |
| 7,063,229 | B2 | 6/2006 | Westerhof et al. | |
| 7,111,748 | B2 | 9/2006 | Cha | |
| 7,159,732 | B2 | 1/2007 | Smith et al. | |
| 7,217,434 | B1 | 5/2007 | Loh et al. | |
| 7,387,063 | B2 | 6/2008 | Vu et al. | |
| D590,662 | S | 4/2009 | Cheng | |
| 7,588,275 | B2 | 9/2009 | Borg | |
| 7,594,584 | B2 | 9/2009 | Durdon et al. | |
| 7,721,911 | B2 | 5/2010 | Chou | |
| D635,855 | S | 4/2011 | Smith et al. | |
| D637,079 | S | 5/2011 | Brown et al. | |
| 8,006,854 | B2 | 8/2011 | Waugh | |
| 2001/0035417 | A1 | 11/2001 | Kantor | |
| 2003/0089714 | A1 | 5/2003 | Dart et al. | |
| 2004/0050724 | A1 | 3/2004 | Grul et al. | |
| 2004/0050847 | A1 | 3/2004 | Yoon | |
| 2004/0084452 | A1 | 5/2004 | Hsieh | |
| 2004/0089662 | A1 | 5/2004 | Smith et al. | |
| 2004/0149755 | A1 | 8/2004 | Olivar | |
| 2004/0182862 | A1 | 9/2004 | Scott | |
| 2005/0035011 | A1 | 2/2005 | McRobbie | |
| 2005/0115845 | A1 | 6/2005 | Cho | |
| 2005/0178677 | A1 | 8/2005 | Morrow | |
| 2005/0178688 | A1 | 8/2005 | Hasson | |
| 2005/0199639 | A1 | 9/2005 | Tucker et al. | |
| 2005/0205437 | A1 | 9/2005 | Huffman et al. | |
| 2005/0269328 | A1 | 12/2005 | Crider et al. | |
| 2006/0060589 | A1 | 3/2006 | Lee | |
| 2006/0096983 | A1 | 5/2006 | Patterson | |
| 2007/0029322 | A1 | 2/2007 | Durdon et al. | |
| 2007/0278122 | A1 | 12/2007 | McCumber | |
| 2008/0023503 | A1 | 1/2008 | Freeman | |
| 2008/0099481 | A1 * | 5/2008 | D'Amato | 220/276 |
| 2008/0230541 | A1 | 9/2008 | Bayss et al. | |
| 2009/0065377 | A1 | 3/2009 | Olomi et al. | |
| 2009/0206089 | A1 | 8/2009 | Mueller | |
| 2009/0236305 | A1 * | 9/2009 | DeMarco et al. | 215/316 |
| 2009/0250479 | A1 | 10/2009 | Kaufman et al. | |
| 2009/0272390 | A1 * | 11/2009 | Blondeel | 131/231 |
| 2011/0114643 | A1 | 5/2011 | Bogdziewicz | |
| 2011/0168719 | A1 | 7/2011 | Lotterhos | |
| 2011/0198351 | A1 | 8/2011 | D'Amato | |
| 2011/0198355 | A1 | 8/2011 | Mullen | |
| 2011/0210126 | A1 | 9/2011 | Vovan | |
| 2011/0248033 | A1 | 10/2011 | Mehrvijeh | |
| 2011/0266295 | A1 | 11/2011 | Yacktman | |
| 2011/0284537 | A1 | 11/2011 | Cerasani | |

* cited by examiner

FIGURE 2A
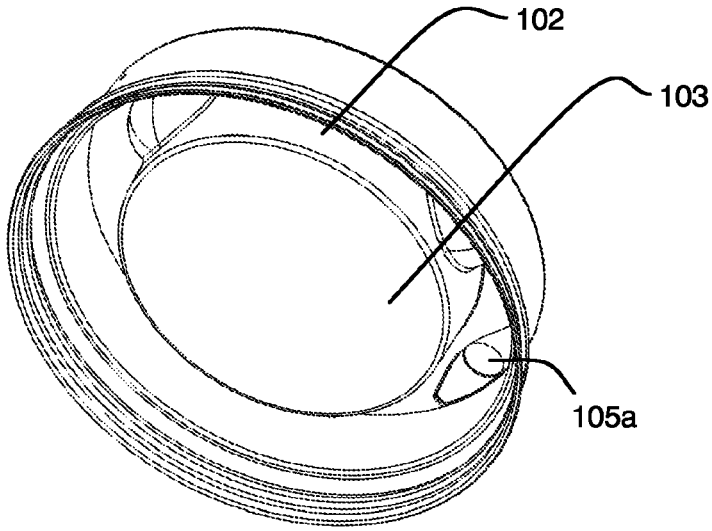
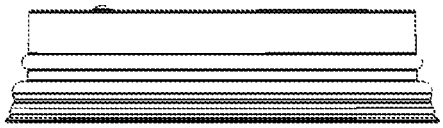
FIGURE 2B
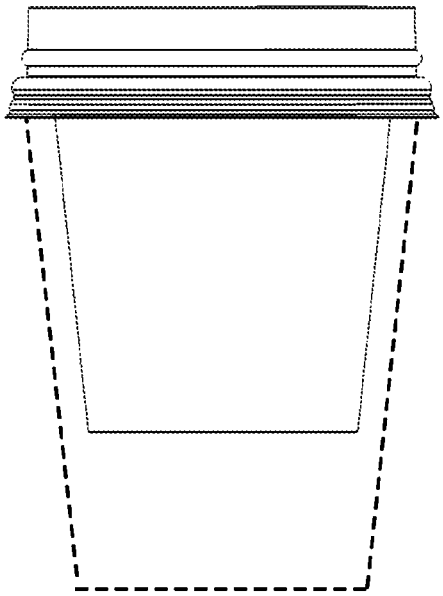
FIGURE 2C

CUP LID WITH INTEGRATED CONTAINER

This application is a continuation of U.S. Utility patent application Ser. No. 13/226,346 filed 6 Sep. 2011, now U.S. Pat. No. 8,596,491 the specification of which is hereby incorporated herein by reference.

BACKGROUND OF THE INVENTION

1. Field of the Invention

One or more embodiments of the invention are related to the field of containers. More particularly, but not by way of limitation, one or more embodiments of the invention enable a cup lid with integrated container that enables for example simultaneous access of the contents of the container and attached cup without disengagement of the cup lid from the cup.

2. Description of the Related Art

Standard cup lids are simple covers that do not include an integrated container. Rather, known lids cover the contents of a cup which forms a closed container in combination with the cup itself. Known containers that couple with cups include food containers that fit onto the top of yogurt cups for example. Known containers have to be removed from the yogurt cup and then flipped over and opened before the contents of the container and cup may be accessed. It is generally not possible to access the contents of the cup while also accessing the contents of the container without first disengaging the container from the cup. Additionally, food containers that attach to yogurt cups in an upside-down position have a limited food-volume capacity. In such cases, as the yogurt example shows, the food-container walls narrow as they proceed upward toward the bottom of the upside down container.

Known containers that couple with bottles include gift containers that fit onto the top of bottles for example. It is generally not possible to access the contents of the bottles while also accessing the contents of the gift containers without disengaging the gift container from the bottle and then disengaging the lid of the bottle.

Thus simultaneous access of the contents of known cups or bottles and of the contents of an attached container is not possible. This makes for difficult drinking/eating coffee, soda, snacks, popcorn, etc., in malls, fast food restaurants, theaters, amusement parks, sports stadiums or in any other venue. For example, this makes it difficult to eat and drink food in a theater or stadium with one cup-holder per seat.

For at least the limitations described above there is a need for a cup lid with integrated container.

BRIEF SUMMARY OF THE INVENTION

One or more embodiments described in the specification are related to a cup lid with integrated container. Embodiments of the cup lid generally provide a cavity, compartment or closed space, wherein the cup lid is configured to couple with the top of a cup. One or more embodiments may include volumes that extend to, into, out of, or both into and out of the plane defined by the circular top of the cup. In this manner, the cup and lid form at least two containment volumes, one volume formed by the bottommost portion of the cup lid and the inner walls of the cup, and another volume within the cup lid itself. Embodiments of the invention enable easy containment, inclusion of fresh foods, transportation and simultaneous access of solid or liquid in the container with solid or liquid held in the cup, without requiring disengagement of the cup lid from the cup.

Embodiments of the invention may be made to fit any cup size, for example a paper coffee cup, and may be quickly attached and removed from the cup. Embodiments may be constructed from vacuum, thermal or injection molding techniques or in any other manner as desired. Any type of material may be utilized in the construction of one or more embodiments of the invention, for example plastic or polymer. One such plastic may be clear or opaque or any level of translucency. Materials may be chosen for strength and function as required. Common polymers thermosetting polymers include epoxy and phenolic materials. Thermoplastic materials that may be utilized include nylon, polyethylene and polystyrene for example. Coffee cup lids are generally white or black and while most soda or drink-cup lids are clear. Any colors or color combinations may be used. One or more embodiments may utilize components of different translucent values, for example a bottom compartment of the container may be white, while the peel-off or press-on lid portion of the container may be clear so that the contents of the container may be viewed without opening the container. The cavity may contain a thermal liner, for example Styrofoam for cold items such as ice cream or frozen yogurt or alternatively for hot items such as sliders, hamburgers, chili or soup. The cavity may include a single or double wall for extra insulative effect or for any other reason. Thermal sensitive plastics, for example thermochromics may also be utilized to show how hot or cold the item in the container is. These types of plastics change color for example based on their temperature. Graphic symbols and/or letters that for example read "Caution Contents Hot", may be displayed for example when the thermochromic is hot, for example in Red, wherein the letters would not be shown otherwise, or would be shown in Blue for example if the contents of the container were not hot. These colors are exemplary and any color including transparent may be chosen to represent hot and cold in any embodiment of the invention. For embodiments that do not utilize thermochromic materials, any graphical symbols or lettering may be utilized to warn or inform a potential user. Graphical symbols and/or lettering may be placed on the top, sides, or inside of the container or in any other area that may be viewed or touched. Graphical symbols and/or lettering may include logos, advertisements, puzzles, promotions, trivia or any other type of information that is viewable and may include tactile information including Braille.

The vertical dimension of the cavity may vary from a low, for example about a half an inch when the container is configured to hold a cookie, to a medium, for example about one and a half inches when the container is configured to hold a doughnut or high, for example up to or more than four inches when the container is configured to hold frozen yogurt, ice cream, a hamburger, French fries, or a sandwich. As one skilled in the art will appreciate, any desired dimension of the container may be utilized as desired for the particular application. The horizontal dimension of the container may be of a width less than, equal to, or greater than the diameter of the cup measured across the plane formed by the top of the cup opening. When the horizontal dimension of the container is less than the diameter of the cup opening, then the vertical offset of the dimension may extend downward into the main volume of the cup. Other embodiments enable containers having a horizontal dimension less than, equal to, or greater than the diameter of the cup opening to reside on top of the plane defined by the cup opening. Other embodiments of the container may include portions having a smaller horizontal dimension to extend into the main volume of the cup and a portion of the container that is smaller, equal to, or larger that also extends above the plane defined by the cup opening.

Embodiments may be constructed from one or more parts. In the case of an embodiment having a container that extends above, and in some instances, below, the horizontal plane of the cup top, two elements may be fused together for example, or molded or formed as a single unit may be two separate units that clip or lock together, or in any other manner. The shape of the container may be of any type, circular, oval, triangular, square or a polygon of any number of sides, or any other shape.

One or more embodiments of the invention may include cut-outs to facilitate lifting of the items from within the cavity. For example, an embodiment with at least one cut-out allows for a finger to be inserted into the cavity in order to provide a lifting force to the item in the cavity. More than one cut-out for example may be employed so that opposing locations in the cavity may be employed to lift the item from the cavity as desired. Cut-outs can also be integrated such that uniform or level stacking may be achieved for ease of storage. Embodiments having three cut-outs, for example, stack evenly regardless of initial positioning; however, this is merely an exemplary embodiment, as other embodiments may be formed to readily stack as desired.

One or more embodiments of the invention may employ a hole such as a sip hole or straw hole for example, so that liquid in the cup may be accessed without removing the container. Any shape of hole or any shape straw, i.e., oblong from a cross-sectional view, for any purpose may be utilized as desired. Embodiments employing a hole may make use of a hole on top of the container, or at the base of the container, adjacent to the outer perimeter of the cup lid, when the container bottom is sufficiently smaller than the diameter of the cup rim, or on a vertical wall of the container for example, so that oversize containers may be utilized that, for example, have a larger diameter than the diameter of cup rim. For example, one embodiment of an oversize container allows for a hamburger or French fries to be placed on top of a soda or beer cup. In this latter configuration, a tri-bend straw is provided to effectively follow the contour of a larger container, located directly above, before heading diagonally upward toward the user.

Although the top container may be heat fused to the cup lid, or made from a single molded or thermal-formed unit, for example, in the case of the large container configuration where the straw exits the vertical side wall, the large container may clip to the cup lid below via a bottom clip-on system or a top vertical wall ridge system. Such clip systems as mentioned here provide for removal and reattachment of the top container to the cup lid, as desired by the user.

Embodiments of the invention may utilize a lid to cover the container, wherein in effect, a cup that is coupled with an embodiment of the invention effectively has two lids, one for the container and one formed by the container with the cup. To avoid confusion, "cover" as utilized herein refers to the lid for the container. Embodiments of covers include seal/peel-off, press-on, i.e., external/internal wall friction, press-on dome, rotational, or swivel types of covers. Seal/peel-off covers may be configured using a thermal bonding process of similar or compatible materials, or may utilize an adhesive that allows the cover to be removed permanently or temporarily depending on the adhesive, to access the cavity. Press-on covers are generally plastic covers that may be removed and placed back on the cavity, for example, when placing fresh foods such as cookies within the cavity, or if the contents of the container have not all been removed. Seal/peel-off and press-on covers may be utilized in combination, so that after the press-on cover and seal/peel-off covers are removed, exposing the contents of the container, then the press-on cover may be placed over the container again to enclose the contents of the container for example. Press-on dome covers for example may also include a hole on top that enables a spoon to access food within the container, such as frozen yogurt. Press-on covers may also include an adjustable open/close sip-hole or straw hole. Press-on external/internal wall friction covers may engage or couple in any manner that utilizes friction for the coupling. Press-on type covers may be implemented with a flat portion that is hinged at any peripheral location of the container that allows the lid to flex open in a clam shell fashion, exposing the contents of the container, while retaining the cover such that it remains attached to the exterior wall of the container.

Items suitable for placement within the container include solids or liquids. For example, items may include any combination of one or more solid and/or liquid alone or in combination. Example items include one or more cookie, doughnuts, chocolates, chips, crackers, nuts, popcorn, candies, ice cream, frozen ice, ice coffee, frozen yogurt, cream, water, soda or coffee, fruit pieces, burgers, French fries, sandwiches, or any other solid or liquid. Items that may be sealed in and stored for use or purchase may be refrigerated after sealing if necessary, or items that are selectively prepared or fresh can be placed into the container and may utilize the press-on cover embodiment if desired based on the particular application.

Embodiments of the invention allow for one-handed transportation and simultaneous access of the contents of the cup and container without disengaging the cup lid from the cup. Although, as specified here within, a clip-on system of engagement of the container to the lid below may be utilized, which allows the user to remove or reattach the top container as desired. Various embodiments allow for ease of carrying and drinking/eating coffee, soda, cookies, snacks, etc., in malls, fast food restaurants, theaters, amusement parks, sport stadiums or in any other venue. For example, this allows a parent in an amusement park to carry food and beverages at the same time with one hand, while providing one hand free to hold the hand of a child for safety. In addition, embodiments of the invention simplify eating and drinking by combining these processes into one container and cup, which is significantly more convenient in theaters or stadiums having seats, for example, which provide a single cup holder for seat.

BRIEF DESCRIPTION OF THE DRAWINGS

The above and other aspects, features and advantages of the invention will be more apparent from the following more particular description thereof, presented in conjunction with the following drawings wherein:

FIG. 2A illustrates a bottom view of an embodiment of the invention, FIG. 2B shows a side view of an embodiment of the invention having a vertical dimension that extends to the plane of the cup opening, FIG. 2C shows a side view of an embodiment of the invention having a vertical dimension that extends into the plane of the cup opening.

DETAILED DESCRIPTION

A cup lid with integrated container will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
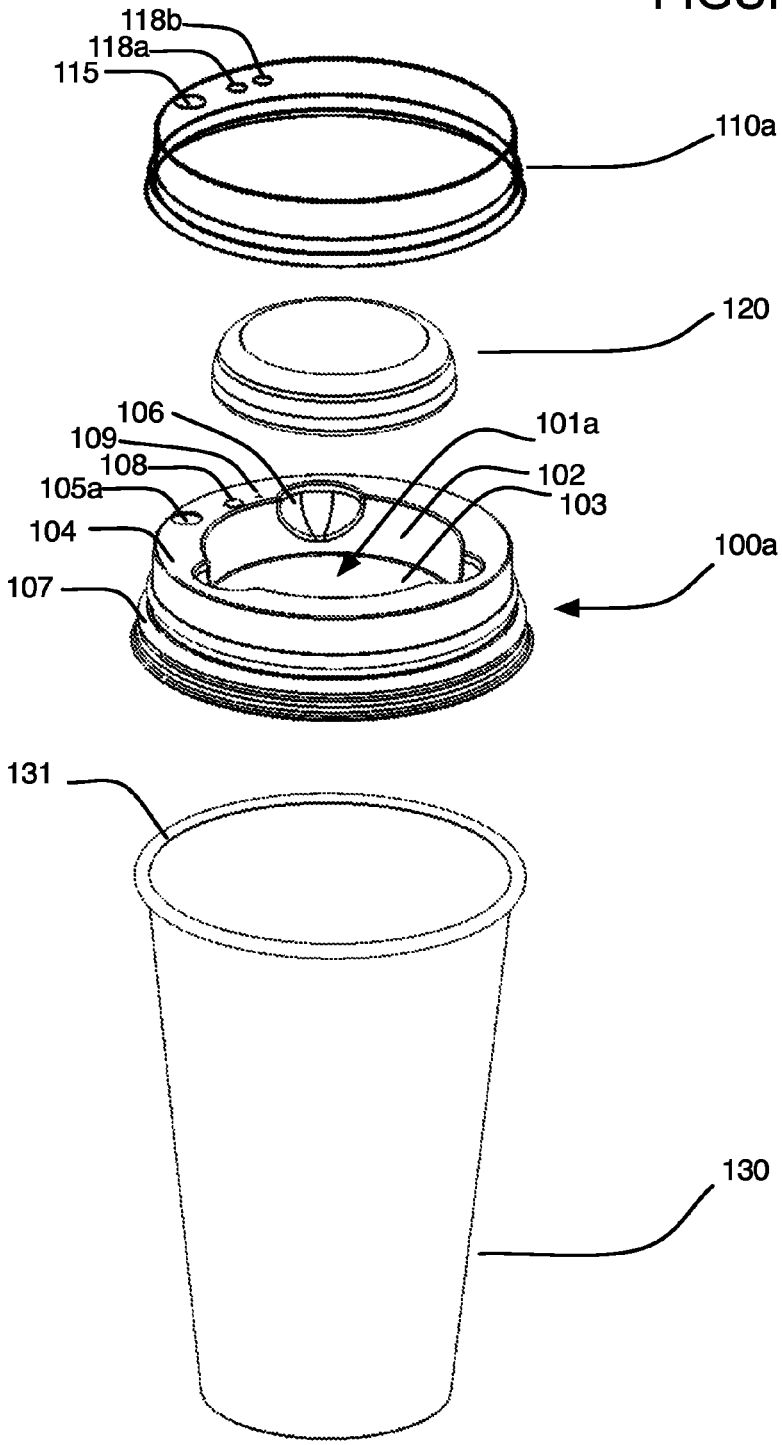
FIG. 1 illustrates an exploded view of an embodiment of the cup lid with integrated container above a cup, along with a food item and a cover.

FIG. 1 illustrates an exploded view of an embodiment of cup lid 100*a* with integrated container or cavity 101*a* shown above cup 130, along with any solid/liquid 120 or food item such as a cookie for example that fits in cavity 101*a*, and cover 110*a*, that covers the food item while the food item is in container 101*a*. Cup lid 100*a* includes coupling element 107 that allows the cup lid to couple with the cup.

Cup lid 100*a* includes at least one wall 102, for example that leads to container bottom 103, which for example may also be considered part of wall 102. As used herein, the term wall is not limited to a surface of any shape, but rather refers to the separation between container 101*a* and the contents of cup 130. Specifically, embodiments of the invention include at least one wall that defines container 101*a* that is configured to store a first solid or a liquid separate from a second solid or liquid stored in cup 130 wherein cup 130 generally includes an annular opening that lies in a plane on top of the cup. The cup as shown also includes a rolled rim 131 that coupling element 107 is configured to couple with to hold cup lid 100*a* onto cup 130. Specifically, coupling element 107 is configured to couple at least one wall to the annular opening on top of said cup, for example by stretching over the smaller diameter portion of the coupling element to allow the rolled edge of the cup to fit into the slightly larger diameter portion of the cup lid. Coupling element 107 is an exemplary form of attachment and any form of attachment may be utilized to couple cup lid 100*a* to cup 130 as one skilled in the art will appreciate including for example a coupling element that includes a more difficult type of coupling to remove or even a permanent coupling.

Horizontal area 104 includes hole 105*a* for example for a straw or sip hole and cut-outs 106. Optional elements include rotation indexer 108 and air hole 109. Rotation indexer 108 is described below with respect to its relation to cover 110*a*. Other optional elements may include optional indicators not shown for brevity, for example configured to press in to show whether the contents of cup 130 are for example diet/regular soda or caffeinated/decaffeinated or to show any other information in a tactile or visible manner.

The at least one wall is configured to enable access of the first solid or liquid and the second solid or liquid without disengagement of the coupling element. For example, the contents of both integrated container 101*a* and cup 130 are accessible without removing the cup lid. This greatly simplifies eating and drinking in cars, theaters and sport stadiums for example that are equipped with one cup-holder per seat.

Cover 110*a* as shown is configured as an external wall friction press-on cover, but may also be configured as a seal/peel-off, press-on dome, press-on dome with hole, internal wall friction press-on, or rotational cover so long as the cover is configured to at least partially enclose the container and retain the contents of the container when the cover is coupled with corresponding version of the cup lid. As shown, cover 110*a* includes hole 115 to allow access of hole 105*a* when cover 110*a* is coupled with cup lid 100*a* and cover 110*a* may also include holes 118*a* and 118*b* that provide discrete rotation values for cover 110*a* when one or the other hole is rotated over the top of rotation indexer 108 on cup lid 100*a*. In one angular rotation, hole 105*a* is open for access and in the other angular rotation, hole 105*a* is thus closed by cover 110*a*. When open, i.e., when hole 105*a* is exposed through cover hole 115, air hole 109 is exposed via hole 118*b* and when closed, air hole 109 is also closed by cover 110*a*.

FIG. 2A illustrates a bottom view of an embodiment of the invention. At least one wall 102 includes a vertical dimension that extends to, into, out of, or both into and out of the plane defined by the annular opening of the cup. Even though FIGS. 1 and 2 show a limited depth container 101*a*, it is noted that this depth may be large enough to hold a typical amount of popcorn in the container while the cup holds a typical amount of soda in the cup. FIG. 2B shows a side view of an embodiment of the invention having a vertical dimension that extends to the plane of the cup opening, this embodiment for example may be utilized to hold a cookie while cup 130 holds a cappuccino for example. FIG. 2C shows a side view of an embodiment of the lid container with a cup shown in dashed lines, having a vertical dimension that extends into the plane of the cup opening, this vertical dimension may be of any size and can be increased such that the embodiment, for example, may be utilized to hold popcorn while cup 130 holds soda for example. Furthermore, at least one wall 102 includes a horizontal dimension, for example across the diameter of the container, having a width less than, equal to, or greater than a width measured across the annular opening of the cup. See also FIG. 12 for embodiments wider than the opening of the cup for example. The embodiment shown in FIG. 2C may itself hold popcorn and fit into a standard popcorn cup that is then utilized for soda, and/or may fit into a cup that has a narrower, or stepped configuration on the bottom half of the cup so as to fit into a standard stadium or movie theater seat cup holder for example. Any type of cup that allows for an embodiment of the invention to be utilized in conjunction with a cup holder for an automobile, or stadium seat, movie theater seat or any other type of cup holder is in keeping with the spirit of the invention.

Figure 3:
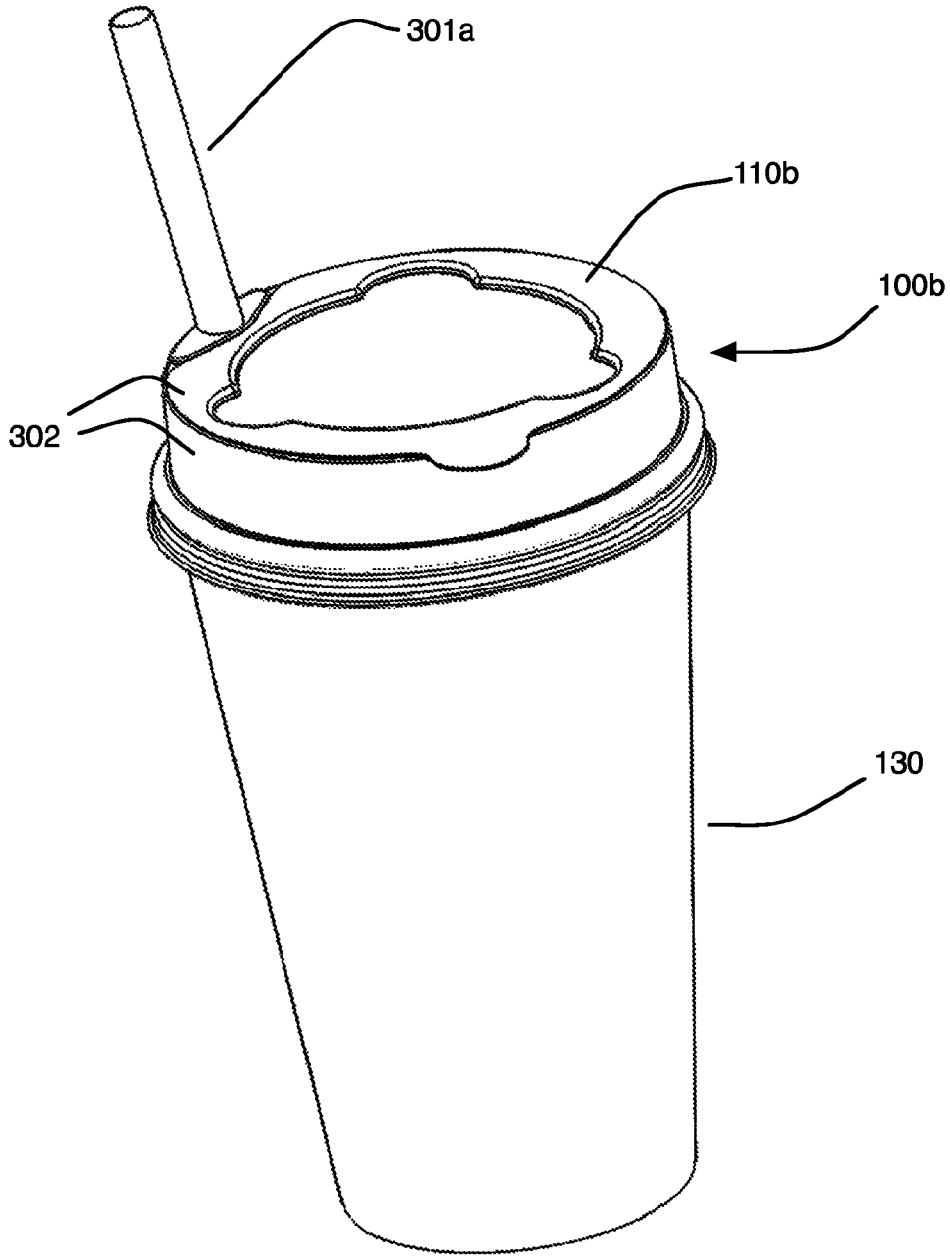
FIG. 3 illustrates a perspective view of an embodiment of the invention coupled with a cup, a seal/peel-off cover and configured to allow access to the contents of the cup via a straw.

FIG. 3 illustrates a perspective view of an embodiment of the invention 100*b* coupled with cup 130, seal/peel-off cover 110*b* and configured to allow access to the contents of the cup via straw 301*a*. The straw configuration is shown as one embodiment, although another embodiment may provide a sip hole or gulp hole for example. Area 302 may include graphic symbols or lettering or both graphic symbols and lettering of visual or tactile form, or logos, advertisements, puzzles, promotions, trivia or information or any combination of any information, including thermochromic materials that show different information based on temperature.

Figure 4:
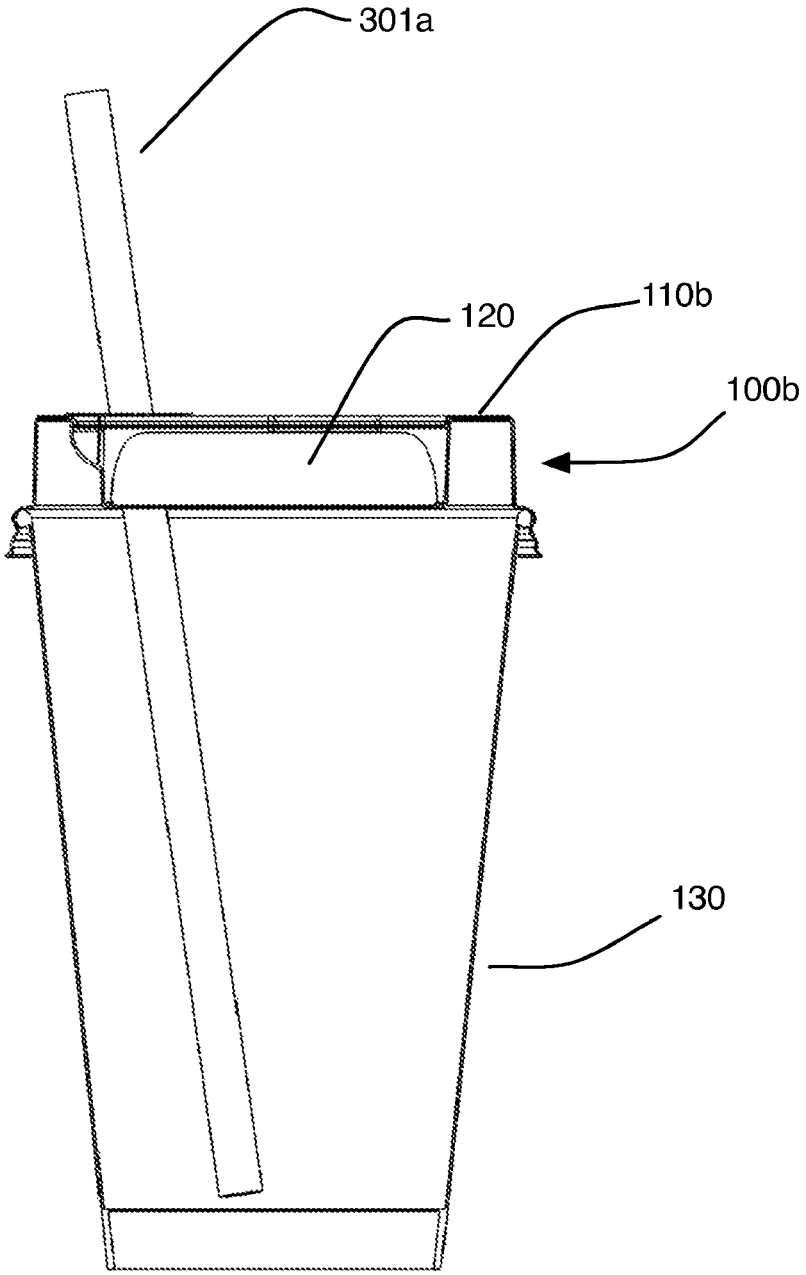
FIG. 4 illustrates a cross sectional view of FIG. 3.

FIG. 4 illustrates a cross sectional view of FIG. 3. As shown, the cup may be a soda, lemonade, coffee, or beer cup, for example, and is not limited to cups with a rolled rim, which are shown herein in an exemplary manner. One or more areas or walls may include a thermochromic plastic configured to change color based on a temperature of the first solid or liquid in the container. First solid or liquid 120 may include any combination of one or more cookie, chocolates, chips, crackers, nuts, popcorn, candies, ice cream, frozen yogurt, fruit pieces, burgers, French fries, sandwiches, milk, cream or any other item. Second liquid or solid in cup 130 may include any combination of ice cream, milk shake, frozen ice, ice coffee, milk, lemonade, water, soda, coffee, beer, mixed alcoholic beverage, frozen ice, ice coffee, or any other item.

Figure 5:
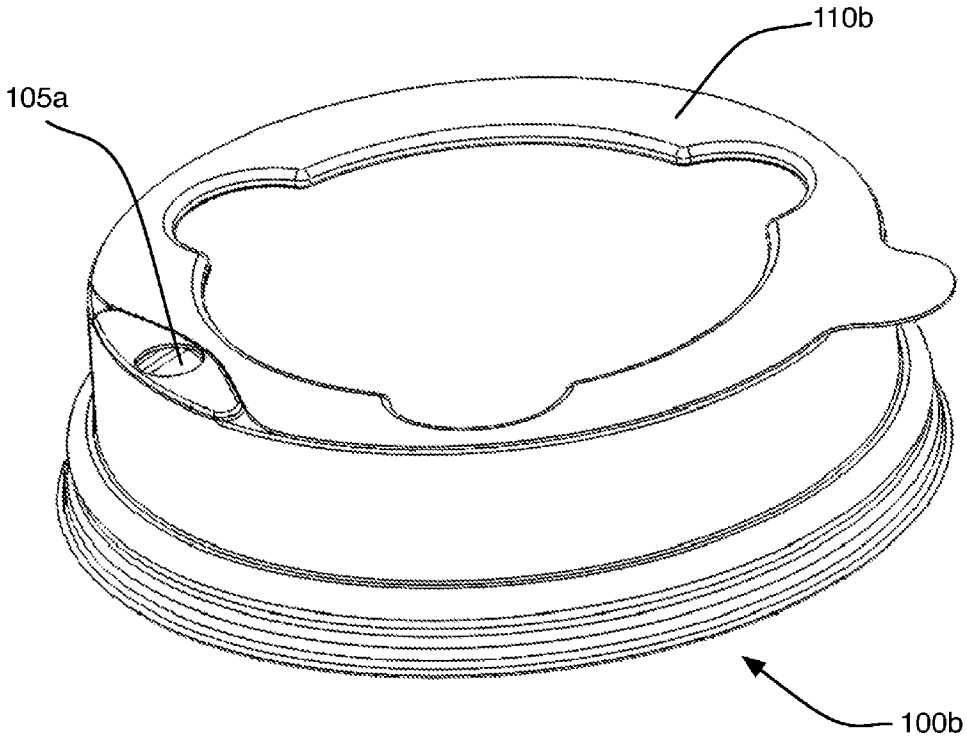
FIG. 5 illustrates a top perspective view of the embodiment shown in FIG. 3.

FIG. 5 illustrates a top perspective view of the embodiment of the invention shown in FIG. 3. The horizontal area on top of the embodiment shown includes hole 105*a* to allow access of the second liquid or solid, i.e., the contents of the cup. Without removing the cup lid, a person may also access the contents of the container on top of the cup. A vertical raised area surrounding the sip hole 105*a* is provided to elevate the sip hole area such that the user's lip does not come into contact with the potentially sharp edge of the container cover. The cover may include any type of hole or cut out area such as a half oval for example that allows for hole 105*a* in the cup lid to be accessed. This is shown as a crescent indentation of cover 110*b* towards the centerline of the cup lid near hole 105*a*. Cover 110*b* is shown as vertically indented slightly downward to match the three finger cut-outs in the cup lid. Vertically indenting the cover acts to locate the cover in a desired position, however this is not required, and cover 110*b* may be implemented in any shape including a flat or planar embodiments as desired.

Figure 6:
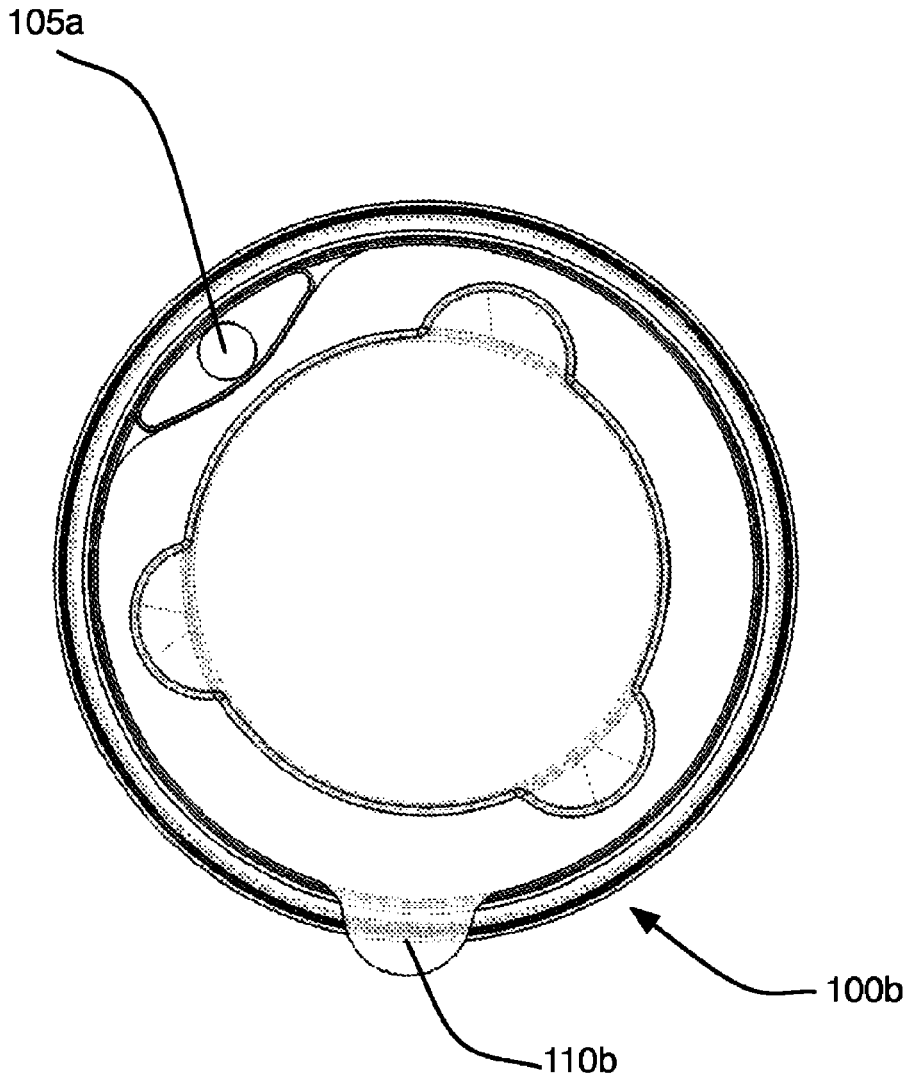
FIG. 6 illustrates a top view of the embodiment of the invention shown in FIG. 3.

FIG. 6 illustrates a top view of the embodiment of the invention shown in FIG. 3. The peel-off tab is shown at the bottom of the figure and allows for the peel-off type cover to be removed from the cup lid.

Figure 7A:
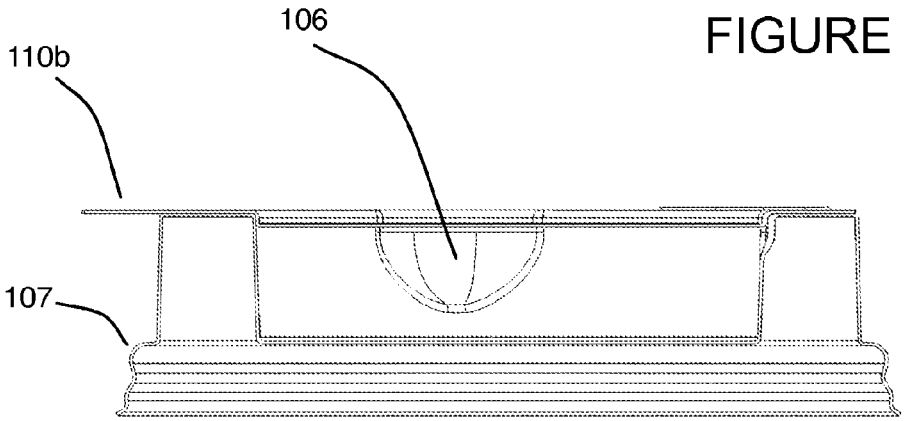
FIG. 7A illustrates a side cross sectional view of the embodiment of the invention shown in FIG. 3.

FIG. 7A illustrates a side cross sectional view of the embodiment of the invention shown in FIG. 3. Cut-outs 106 are configured to facilitate removal of items from within the container. The cut-outs are not required as some types of items to be stored in the container may not need cut-outs for finger access, e.g., ice cream. As shown the walls include two lines which may indicate a particular thickness of one wall or may indicated two or more walls to enable for more insulative embodiments.

Figure 7B:
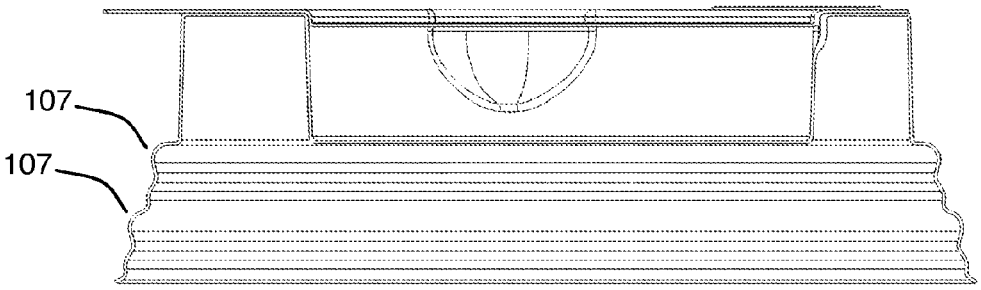
FIG. 7B illustrates a side cross sectional view of the embodiment of the invention shown having two or more coupling elements configured to couple with cups of different sizes.

FIG. 7B illustrates a side cross sectional view of the embodiment of the invention shown having two or more coupling elements configured to couple with cups of different sizes. In this figure, more than one coupling element, here 107 having different diameters are employed so that embodiments of the invention may fit different sized cups. For example, the embodiment shown in FIG. 7B may be sized to couple with large or small coffee cups or large or small soda cups. In addition, three or more coupling elements 107 may also be employed having three or more differing diameters, so that embodiments of the invention may couple with small, medium and large cups as one skilled in the art will appreciate. In this manner, only one size of cup lid, albeit with as many diameter coupling elements as desired, may be utilized to accommodate the different sized cups utilized. Although the embodiment shown has vertically offset coupling elements, other embodiments may utilize coupling elements that are horizontally offset without a vertical offset as one skilled in the art will appreciate.

Figure 7C:
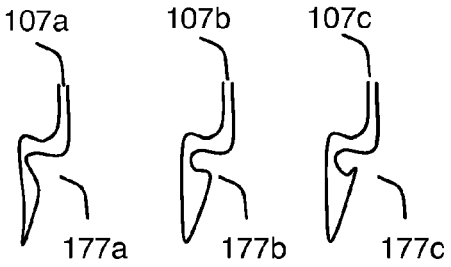
FIG. 7C illustrates different embodiments of coupling elements that may be utilized to attach the top container to the cup rim.

FIG. 7C illustrates different embodiments of coupling elements that may be utilized with embodiments of the cup lid. Cross section of coupling element 107*a* is similar to coupling element 107, and may be easier to decouple from the cup lid based on the large angle at bend 177*a*. Cross section of coupling element 107*b* is a harder-to-remove version of coupling element 107 based on the smaller angle at bend 177*b*, which requires more force to remove from the rolled edge of a cup for example. Cross section of coupling element 107*c* shows a semi-permanent or permanent coupling element based on the hook-like sharp angle at bend 177*c*. Depending on the stiffness of the material utilized in construction of the cup lid, the sharp angle at bend 177*c* may allow for the entire cup, even if full of liquid, to be lifted by the cup lid. This prevents spills by keeping the cup lid and cup attached even with large forces involved. As one skilled in the art will appreciate, multiple diameter coupling elements (as shown in FIG. 7B) on one cup lid may utilize any combination of the coupling elements 107*a*, 107*b* or 107*c* in any embodiment of the invention. For example, in one embodiment, the smallest diameter coupling element on the top portion of FIG. 7B may utilize coupling element 107*a* or 107*b* while the lower coupling element on the bottom portion of FIG. 7B may utilize coupling element 107*b* or 107*c* for example to allow for more strength for large cups that may weigh more. Any number of different diameters may be utilized with any embodiment of the coupling element and any other coupling element known in the art may be utilized if desired and based on the application as one skilled in the art will appreciate.

Figure 8:
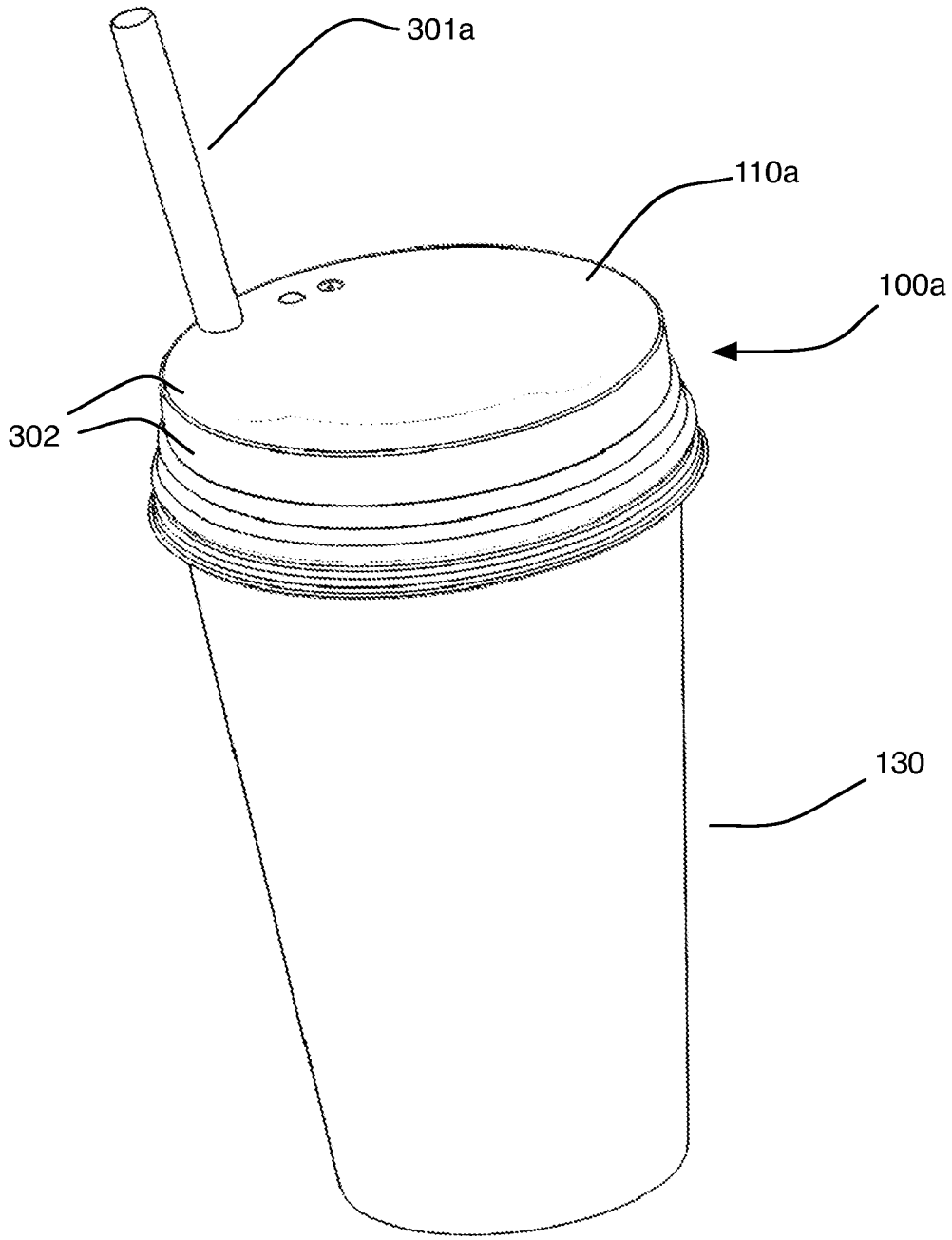
FIG. 8 illustrates a perspective view of an embodiment of the invention coupled with a cup, a press-on cover and configured to allow access to the contents of the cup via a straw.

FIG. 8 illustrates a perspective view of an embodiment of the invention 100*a* coupled with cup 130, press-on cover 110*a* and configured to allow access to the contents of the cup via straw 301*a*.

Figure 9:
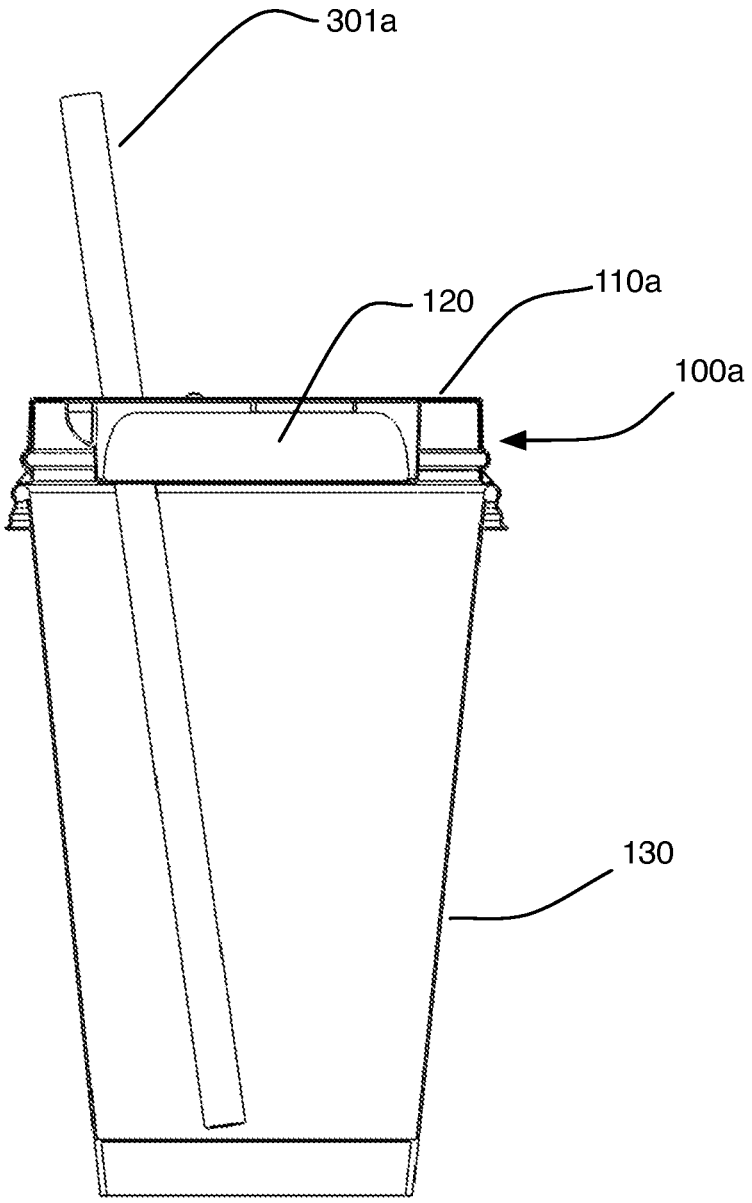
FIG. 9 illustrates a cross sectional view of FIG. 8.

FIG. 9 illustrates a cross sectional view of FIG. 8. Press-on cover 110*a* extends down the sides of the cup lid to couple with the cup lid as is described in more detail below with respect to FIG. 10.

Figure 10:
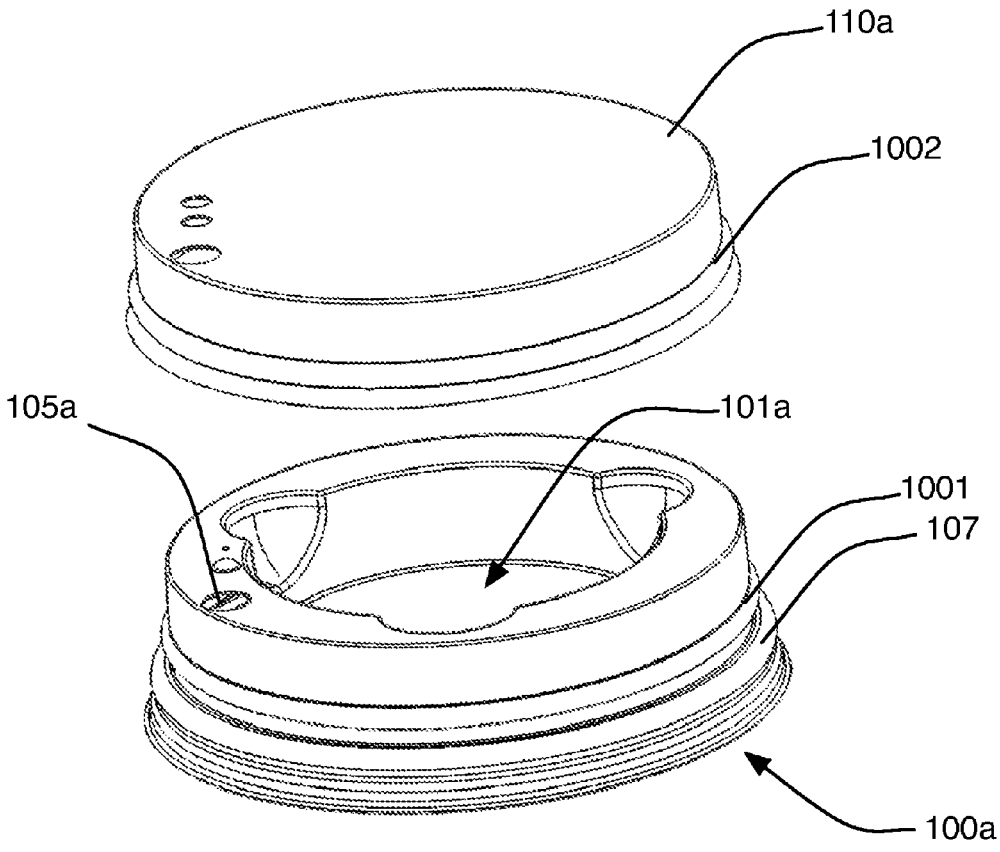
FIG. 10 illustrates a top perspective view of the embodiment of the invention shown in FIG. 8 along with an embodiment of a press-on cover.

FIG. 10 illustrates a top perspective view of the embodiment of the invention shown in FIG. 8 along with an embodiment of a press-on cover. As shown, cover coupling element 1001 on embodiment 100*a* is configured to couple with cover coupling element 1002 on cover 110*a*. This allows for cover 110*a* to press onto cup lid 100*a* in a non-permanent manner that allows for cover 110*a* to be removed by pulling cover 110*a* vertically as shown with enough force to move cover coupling element 1002 away from cover coupling element 1001.

Figure 11:
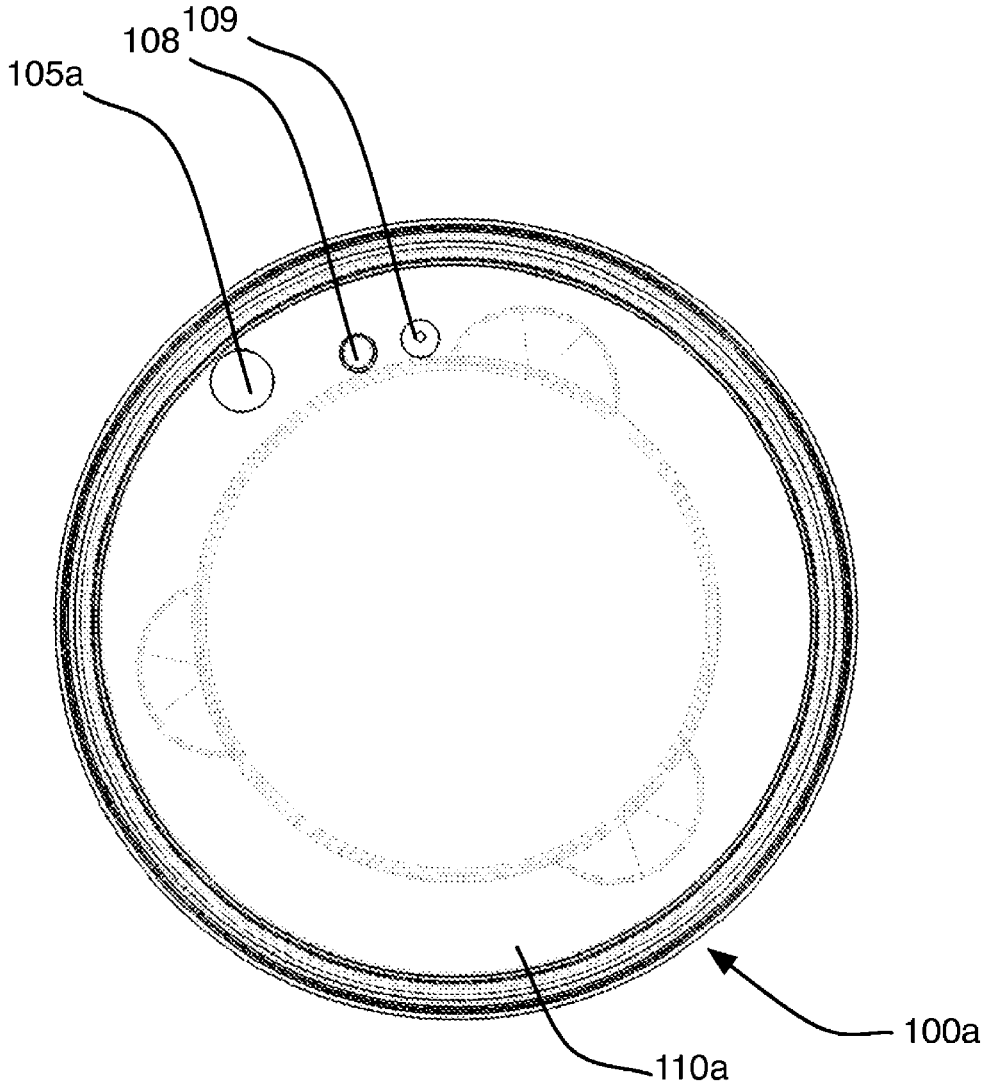
FIG. 11 illustrates a top view of the embodiment of the invention shown in FIG. 8 along with the open/close positioning holes for sealing off or providing access to the sip hole or straw hole.

FIG. 11 illustrates a top view of the embodiment of the invention shown in FIG. 8 showing sip hole open/close rotation index 108 of which there are two in the embodiment shown of which one is called out with reference number 108, the other of which is not called out for brevity, vacuum release pin hole 109 and hole 105*a*. Optional indicators may also be utilized on the top of cover 110*a* (not shown for brevity) which may be tactile or visual indicators of any information, including information as to whether the contents of the container or cup are of a certain type, e.g., chocolate/vanilla, caffeinated/decaffeinated, diet/regular, or any other information.

Figure 12A:
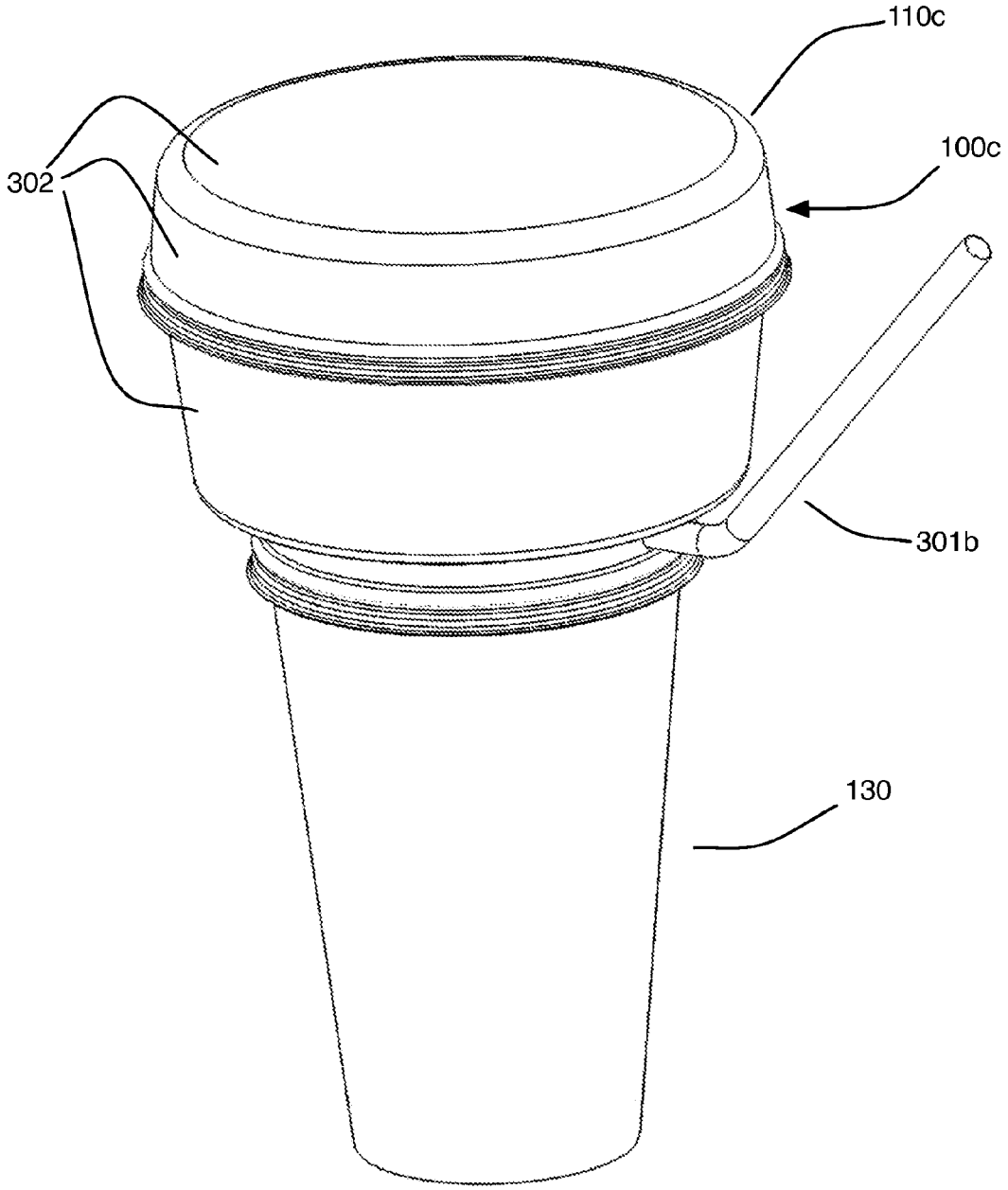
FIG. 12A illustrates a perspective view of an embodiment of the invention coupled with a cup, a dome cover and configured to allow access to the contents of the cup via a straw.
Figure 12B:
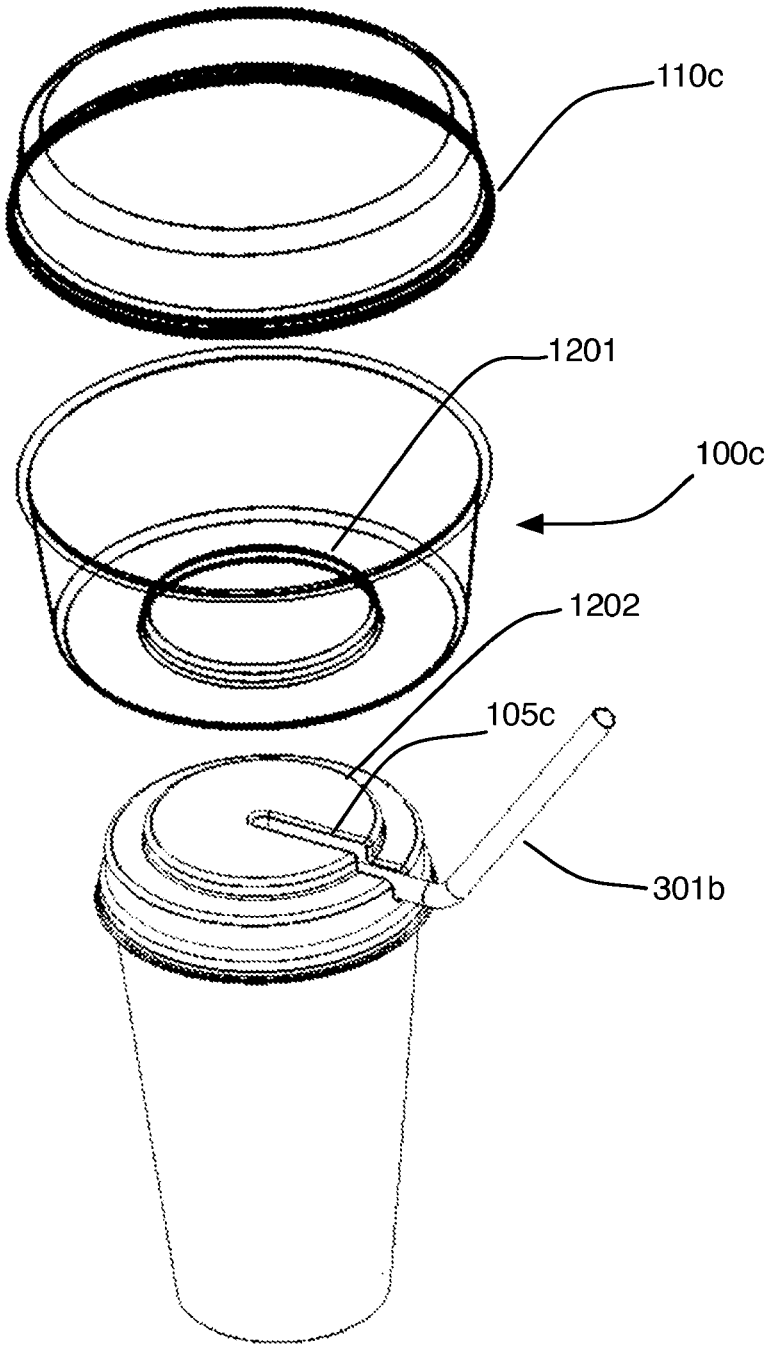
FIG. 12B illustrates an exploded view of a different embodiment of the base portion of the cup lid having a channel for the straw to travel up and out of the cup lid and a raised circular friction clip ridge that allows for the disengagement/reattachment of the top container to the cup lid below.

FIG. 12A illustrates a perspective view of an embodiment of the invention 100*c* with dome cover 110*c* coupled with cup 130, and configured to allow access to the contents of the cup via straw 301*b*. Any of the embodiments of the cup lid may include a separate or integrated thermal liner configured to reside within the container and configured to hold hot or cold items as one skilled in the art will appreciate. Alternatively, or in combination, at least one wall may be a double wall having for example an air gap that provides additional insulation between the temperatures in the container versus the cup as one skilled in the art will appreciate. FIG. 12B shows channel 105*c* with a hole in the inner portion of the base of the cup lid for straw 301*b* to exit from the cup. The upper portion of cup lid 100*c* may attach in any manner such as via a circular coupling element 1201 to the lower portion of the cup lid that couples with the cup at 1202, as shown in the figure surrounding the straw channel. In one or more embodiments of the invention, the bottom portion of cup lid 100*c*, i.e., the lower portion of the container, may include a non-permanent, semi-permanent or permanent coupling element to attach with the lower portion of the cup lid shown attached to the top of the cup. In this manner, the container portion of cup lid 100*c* may be disengaged from the lower portion of the cup lid that then remains on the cup. The coupling element between the upper portion of cup lid 100*c* and lower portion of the container may be of any type in relation coupling elements. See for example the vertical wall coupling element that couples with the cup itself, shown in FIG. 7A, coupling element 107 for example. A screw type of coupling, or adhesive, or one-way coupling element may also be utilized as desired to provide for non-permanent, semi-permanent or permanent coupling types.

Figure 13:
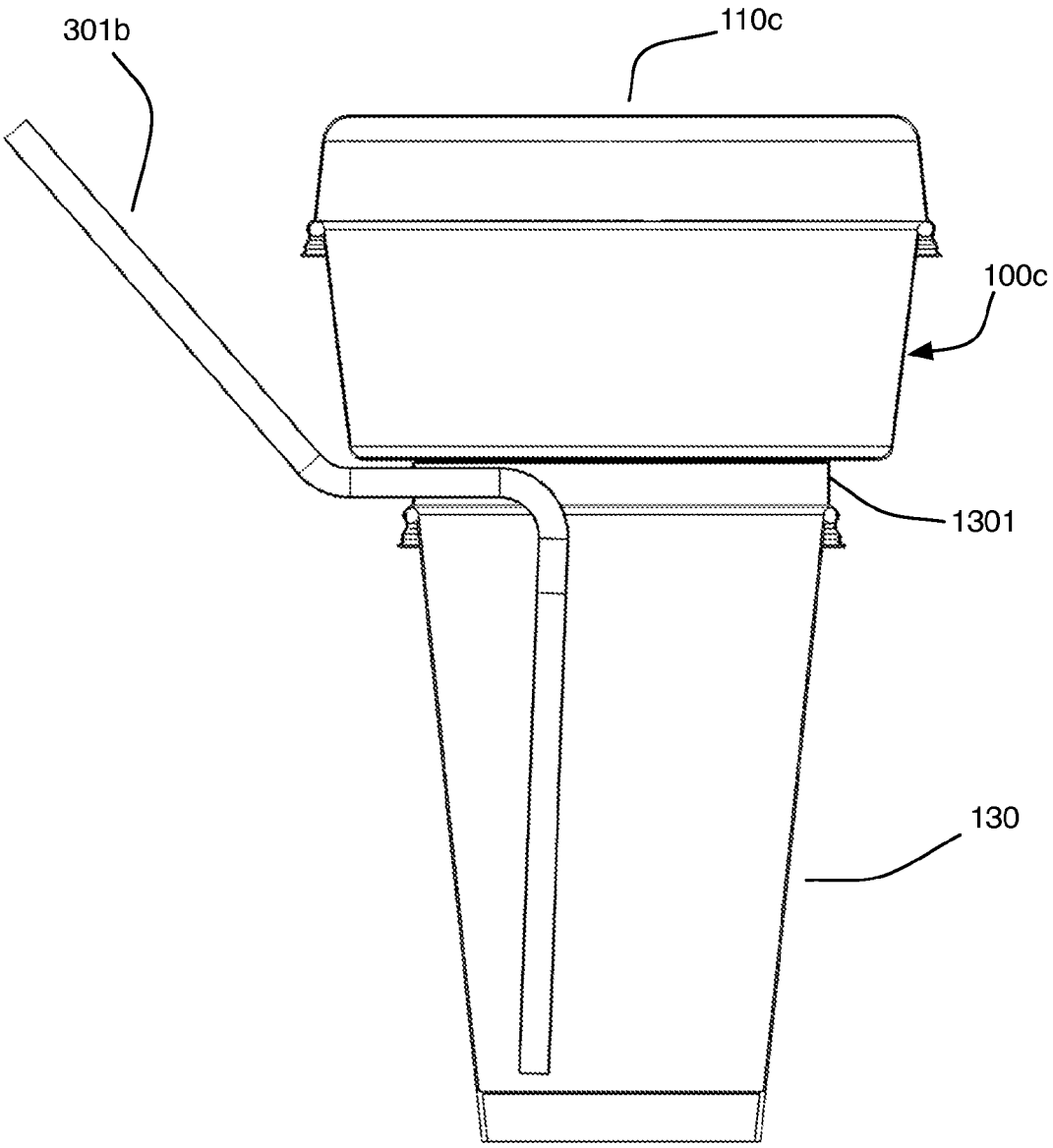
FIG. 13 illustrates a cross sectional view of FIG. 12, along with a tri-bend straw configuration.

FIG. 13 illustrates a cross sectional view of FIG. 12 showing straw 301*b* exiting from a vertical wall 1301 of embodiment 100*c*. A straw with more than one bend for example may be utilized with this embodiment.

Figure 14:
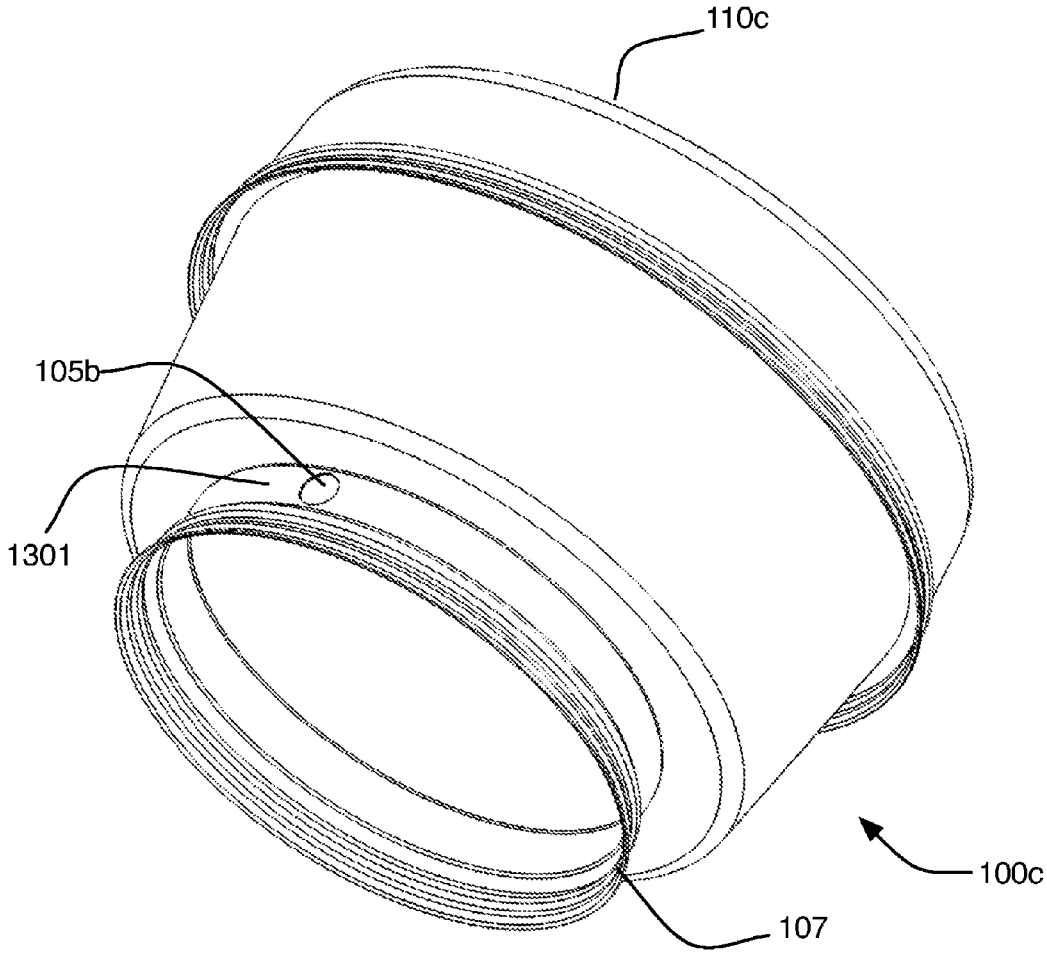
FIG. 14 illustrates a bottom perspective view of the embodiment of the invention shown in FIG. 12 along with an embodiment of the dome cover and a sip hole located in the vertical wall of the cup lid.

FIG. 14 illustrates a bottom perspective view of the embodiment of the invention shown in FIG. 12 showing hole 105*b* along with embodiment that includes dome cover 110*c*. The top horizontal area of the lower cup lid that couples with the cup via coupling element 107 may be bonded to the upper container in any manner or may be formed as part of the upper container as desired. Cover 110*c* may couple with container 100*c* in any manner desired as one skilled in the art will appreciate.

Figure 15:
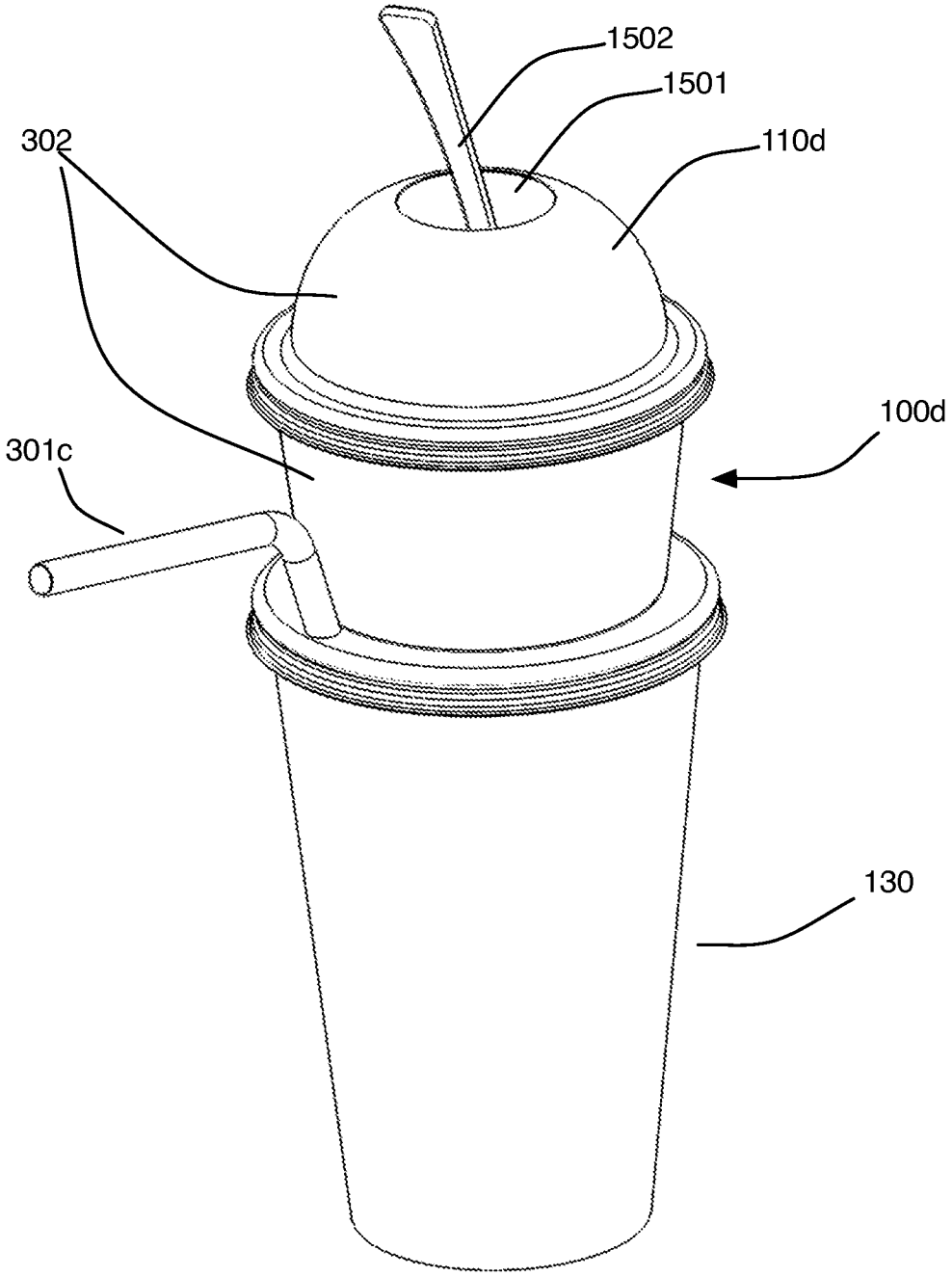
FIG. 15 illustrates a perspective view of an embodiment of the invention coupled with a cup, a dome cover with a hole for a spoon/fork or any other eating utensil and configured to allow access to the contents of the cup via a straw.

FIG. 15 illustrates a perspective view of an embodiment of the invention 100*d* coupled with a cup, a dome cover 110*d* with hole 1501 for example for access of the contents of the container via spoon 1502 and configured to allow access to the contents of the cup via a straw via a hole in a horizontal portion of cup lid 100*d*. This embodiment has a horizontal dimension of the bottom of the container that is less than the diameter of the opening of the cup as opposed to the embodiment shown in FIG. 12 for example.

Figure 16:
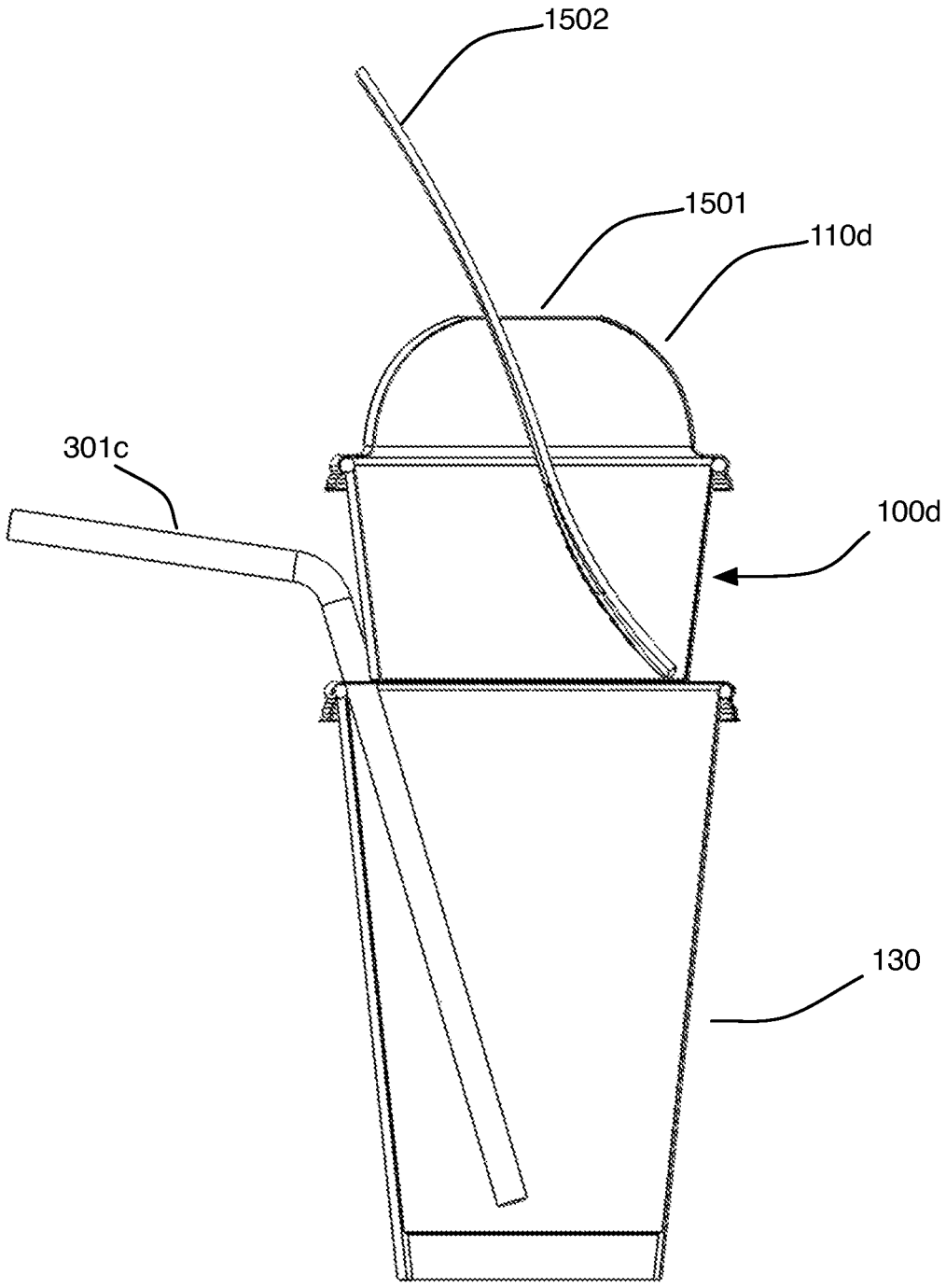
FIG. 16 illustrates a cross sectional view of FIG. 15.

FIG. 16 illustrates a cross sectional view of FIG. 15. Although the vertical dimension of the container has a depth that is at the plane of the opening of the cup, this is not required and may be of any depth into or out of the plane defined by the opening of the cup as desired based for example on the type of solid or liquid to be placed in the container and also in the cup.

Figure 17:
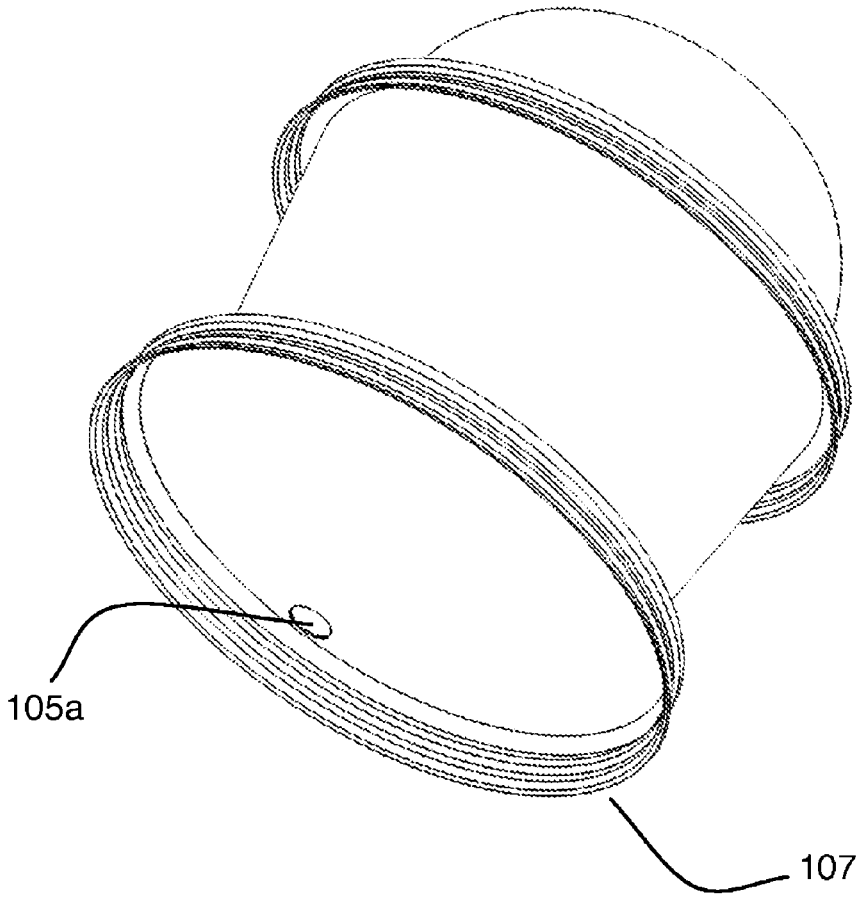
FIG. 17 illustrates a bottom perspective view of the embodiment of the invention shown in FIG. 15 along with an embodiment of a dome cover and a sip hole located in the horizontal wall of the cup lid.

FIG. 17 illustrates a bottom perspective view of the embodiment of the invention shown in FIG. 15 along with an embodiment of the dome cover with a hole. As shown hole 105*a* is located in a horizontal plane of the cup lid as opposed to the embodiment shown in FIG. 13 where the straw hole is located in the vertical portion or wall of the cup lid based on the diameter of the container in that embodiment which has an overall horizontal dimension, including the bottom of the container that is greater than the diameter of the opening of the cup for example.

Figure 18:
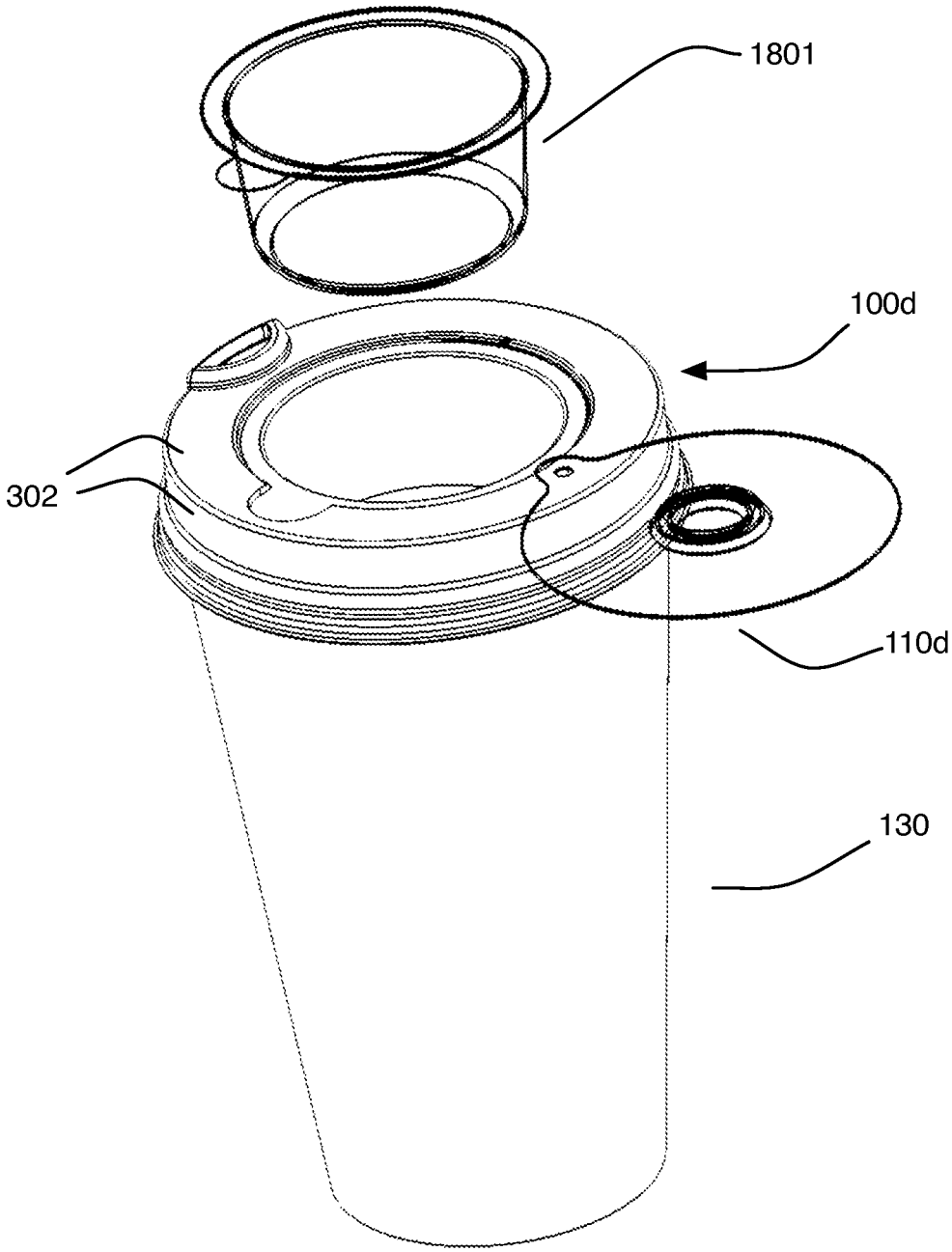
FIG. 18 illustrates an embodiment of the invention with a swivel cover and internal removable container.

FIG. 18 illustrates an embodiment of the invention with swivel cover 110*d* and internal removable container 1801. As shown cup lid 100*d* includes a sip hole or gulp-size hole shown on the left side of the figure, although optionally a straw of any shape or size may be utilized in conjunction with this hole. In addition, this embodiment includes swivel cover 110*d* that may be opaque or transparent or any level of translucency as desired. In one or more embodiments, although not shown in FIG. 18 for brevity, the axis of rotation of the swivel cover may be around the sip hole, straw hole or gulp hole or located anywhere else on the cup lid. The swivel cover 110*d* is swiveled shut to close off or contain the contents of the removable internal container after the peel-seal cover is removed and discarded. In one or more embodiments, the swivel cover is closed to contain loose contents such as nuts prior to lifting and tilting the cup in order to gulp or sip liquids such as beer. Spilling loose contents from the top container is not an inherent issue when using straw configurations. Although not shown within FIG. 18 for brevity, the internal removable container may clip or fasten within the lid cavity in any manner. As one skilled in the art will appreciate, more than one internal removable cup or container may be placed in the lid cavity or cavities, for example cream and sugar. One such clip-on or fastening system that may be utilized is previously shown in FIG. 12B, where 100*c* is configured to clip on or fasten, via a horizontal wall bottom-oriented system, to the cup lid that is positioned directly below. Vertical wall clip on systems may also be utilized to attach the internal removable container to the lid cavity. An example of an internal removable container that may use a bottom-oriented clip-on system within the lid cavity, is a low-profile, single-cookie container with a peel-seal lid that clips within the lid cavity of a coffee cup. An additional example is a removable container with a peel-seal lid that holds beer nuts that clips within the lid cavity of a plastic beer cup. Additionally, a clip system may have been used in this latter embodiment, where a circular clip ridge is located in the top vertical wall area of the removable container and cup lid cavity. This additional vertical wall location, where a circular clip ridge may occur, applies to fixing a low-profile cookie container to a coffee-cup lid cavity, or fixing a medium-deep, i.e., proceeds vertically downward into the cup volume, salty-sweet nut container to a beer-cup lid cavity, or a high-profile hamburger or French-fry container to a beer, soda, or milk shake lid cavity.

While the invention herein disclosed has been described by means of specific embodiments and applications thereof, numerous modifications and variations could be made thereto by those skilled in the art without departing from the scope of the invention set forth in the claims.

What is claimed is:

1. A cup lid with integrated container comprising:

a lid container configured to store a first solid or a liquid separate from a second solid or liquid stored in a cup wherein said cup comprises an annular opening that lies in a plane on top of said cup wherein said lid container is configured with a substantially flat bottom;

a coupling element configured to couple said lid container to said annular opening on top of said cup;

said lid container configured to enable access of said first solid or liquid and said second solid or liquid without disengagement of said coupling element from said cup;

said lid container comprising a hole configured to enable access of said second solid or liquid stored in said cup at an outer portion of said lid container proximal to an outer wall of said cup wherein said hole is not located within said lid container where said first solid or liquid is stored;

said lid container comprising a rotation indexer configured as a protrusion on said lid container that extends away from a portion of said lid container;

a cover comprising an exterior top surface coupled with said lid container and configured to enclose said lid container wherein said cover comprises two or more rotation indexer elements in said exterior top surface of said cover configured to vertically engage said rotation indexer of said lid container to provide discrete rotational values for said cover with respect to said lid container, wherein said cover further comprises a corresponding hole with respect to said hole in said lid container, wherein said corresponding hole is configured to allow access of said lid container hole when said cover is coupled with said lid container, wherein in one of said rotational values said lid container hole and said corresponding hole align over one another when a first rotation indexer element of said two or more rotation indexer elements is rotated over said rotation indexer, and wherein in another of said rotational values, said lid container hole and said corresponding hole do not align over one another when the second rotation indexer element is rotated over said rotation indexer; and, wherein said lid container optionally comprises cut-outs configured to facilitate removal of items from within the lid container.

2. The cup lid with integrated container of claim 1, wherein said coupling element comprises a non-permanent coupling element.

3. The cup lid with integrated container of claim 1, wherein said coupling element comprises a permanent coupling element.

4. The cup lid with integrated container of claim 1, further comprising at least one internal removable container configured to reside in said lid container.

5. The cup lid with integrated container of claim 1, wherein said lid container comprises a vertical dimension that extends to, into, out of, or both into and out of the plane defined by the annular opening of the cup.

6. The cup lid with integrated container of claim 1, wherein said lid container comprises a horizontal dimension having a width less than, equal to, or greater than a width measured across said annular opening of said cup.

7. The cup lid with integrated container of claim 1, wherein said lid container comprises a vertical dimension that extends to or into the plane defined by the annular opening of the cup; and, a horizontal dimension having a width less than a width measured across said annular opening of said cup.

8. The cup lid with integrated container of claim 1, wherein said lid container comprises a vertical dimension that extends to or out of the plane defined by the annular opening of the cup; and, a horizontal dimension having a width less than, equal to, or greater than a width measured across said annular opening of said cup.

9. The cup lid with integrated container of claim 1, wherein said cup comprises a coffee cup, soda cup, lemonade cup, milk cup, shake cup, alcoholic beverage cup, or beer cup.

10. The cup lid with integrated container of claim 1, further comprising:

a thermal liner configured to reside within said lid container and configured to hold hot or cold items.

11. The cup lid with integrated container of claim 1, wherein said lid container comprises a plurality of walls.

12. The cup lid with integrated container of claim 1, wherein said lid container comprises a thermochromic plastic configured to change color based on a temperature of said first solid or liquid.

13. The cup lid with integrated container of claim 1, wherein said lid container comprises graphic symbols or lettering or both graphic symbols and lettering of visual or tactile form or logos, advertisements, puzzles, promotions, trivia or information.

14. The cup lid with integrated container of claim 1, wherein said lid container is configured to hold said first liquid or solid that comprises one or more cookie, chocolates, chips, crackers, nuts, popcorn, candies, ice cream, frozen yogurt, milk, cream, fruit pieces, burgers, French fries, or sandwiches and wherein said second liquid or solid comprises milk shake, frozen ice, ice coffee, lemonade, milk, cream, water, soda, coffee, alcoholic beverage or beer.

15. A cup lid with integrated container comprising:

a lid container configured to store a first solid or a liquid separate from a second solid or liquid stored in a cup wherein said cup comprises an annular opening that lies in a plane on top of said cup wherein said lid container is configured with a substantially flat bottom;

a coupling element configured to couple said lid container to said annular opening on top of said cup;

wherein said coupling element comprises multiple different diameters configured on said lid container;

said lid container configured to enable access of said first solid or liquid and said second solid or liquid without disengagement of said coupling element from said cup;

said lid container comprising a hole configured to enable access of said second solid or liquid stored in said cup at an outer portion of said lid container proximal to an outer wall of said cup wherein said hole is not located within said lid container where said first solid or liquid is stored;

said lid container comprising a rotation indexer configured as a protrusion on said lid container that extends away from a portion of said lid container;

a cover comprising an exterior top surface coupled with said lid container and configured to enclose said lid container wherein said cover comprises two or more rotation indexer elements in said exterior top surface of said cover configured to vertically engage said rotation indexer of said lid container to provide discrete rotational values for said cover with respect to said lid container, wherein said cover further comprises a corresponding hole with respect to said hole in said lid container, wherein said corresponding hole is configured to allow access of said lid container hole when said cover is coupled with said lid container, wherein in one of said rotational values said lid container hole and said corresponding hole align over one another when a first rotation indexer element of said two or more rotation indexer elements is rotated over said rotation indexer, and wherein in another of said rotational values, said lid container hole and said corresponding hole do not align over one another when the second rotation indexer element is rotated over said rotation indexer;

wherein said lid container optionally comprises cut-outs configured to facilitate removal of items from within the container;

wherein said lid container comprises a vertical dimension that extends to or downward into the plane defined by the annular opening of the cup and, a horizontal dimension having a width less than a width measured across said annular opening of said cup, or a vertical dimension that extends to or upward out of the plane defined by the annular opening of the cup and, a horizontal dimension having a width less than, equal to, or greater than a width measured across said annular opening of said cup; and wherein said lid container comprises a horizontal area or a vertical area having a hole to allow access of air above said second liquid or solid, wherein said horizontal area hole or said vertical area hole is different than said lid container hole.

16. A cup lid with integrated container comprising:

a lid container configured to store a first solid or a liquid separate from a second solid or liquid stored in a cup wherein said cup comprises an annular opening that lies in a plane on top of said cup wherein said lid container is configured with a substantially flat bottom;

a coupling element configured to couple said lid container to said annular opening on top of said cup;

wherein said coupling element comprises multiple different diameters on said lid container;

said lid container configured to enable access of said first solid or liquid and said second solid or liquid without disengagement of said coupling element from said cup;

said lid container comprising a hole configured to enable access of said second solid or liquid stored in said cup at an outer portion of said lid container proximal to an outer wall of said cup wherein said hole is not located within said lid container where said first solid or liquid is stored;

said lid container comprising a rotation indexer configured as a protrusion on said lid container that extends away from a portion of said lid container;

a cover comprising an exterior top surface coupled with said lid container and configured to enclose said lid container wherein said cover comprises two or more rotation indexer elements in said exterior top surface of said cover configured to vertically engage said rotation indexer of said lid container to provide discrete rotational values for said cover with respect to said lid container, wherein said cover further comprises a corresponding hole with respect to said hole in said lid container, wherein said corresponding hole is configured to allow access of said lid container hole when said cover is coupled with said lid container, wherein in one of said rotational values said lid container hole and said corresponding hole align over one another when the first rotation indexer element of said two or more rotation indexer elements is rotated over said rotation indexer, and wherein in another of said rotational values, said lid container hole and said corresponding hole do not align over one another when the second rotation indexer element is rotated over said rotation indexer;

wherein said cover further comprises two covers, wherein said two covers comprise a seal-peel-off cover and a press-on cover, such that said seal-peel-off cover and said press-on cover are configured to be removed and placed back;

wherein said lid container comprises a vertical dimension that extends to or downward into the plane defined by the annular opening of the cup and, a horizontal dimension having a width less than a width measured across said annular opening of said cup, or a vertical dimension that extends to or upward out of the plane defined by the annular opening of the cup and, a horizontal dimension having a width less than, equal to, or greater than a width measured across said annular opening of said cup;

said lid container comprising a thermochromic plastic configured to change color based on a temperature of said first solid or liquid;

wherein said lid container comprises graphic symbols or lettering or both graphic symbols and lettering of visual or tactile form, or logos, advertisements, puzzles, trivia or information;

wherein said lid container optionally comprises cut-outs configured to facilitate removal of items from within the container;

wherein said lid container comprises a horizontal area having a hole to allow access of said second liquid or solid or a vertical area having a hole to allow access of said second liquid or solid;

wherein said horizontal area hole or said vertical area hole is different than said lid container hole and is configured as an air hole;

wherein said lid container is configured to hold said first liquid or solid that comprises one or more cookie, chocolates, chips, crackers, nuts, popcorn, candies, ice cream, frozen yogurt, milk, cream, fruit pieces, burgers, French fries, or sandwiches; and, wherein said lid container is configured to hold said second liquid or solid that comprises milk shake, frozen ice, ice coffee, lemonade, milk, cream, water, soda or coffee, alcoholic beverage or beer.

17. The cup lid with integrated container of claim 1, wherein said coupling element comprises multiple different diameters on said lid container.

18. The cup lid with integrated container of claim 1, wherein said cover further comprises two covers, wherein said two covers comprise a seal-peel-off cover and a press-on cover, such that said seal-peel-off cover and said press-on cover are configured to be removed and placed back.

19. The cup lid with integrated container of claim 15, wherein said cover further comprises two covers, wherein said two covers comprise a seal-peel-off cover and a press-on cover, such that said seal-peel-off cover and said press-on cover are configured to be removed and placed back.

20. The cup lid with integrated container of claim 1, wherein substantially flat bottom is circular and concentric with said annular opening of said cup.

* * * * *